US012262856B2

(12) United States Patent
Ono et al.

(10) Patent No.: US 12,262,856 B2
(45) Date of Patent: Apr. 1, 2025

(54) MANUAL CLEANING TOOL

(71) Applicant: Nippon Seal Co., Ltd., Osaka (JP)

(72) Inventors: Hiroshi Ono, Osaka (JP); Yusuke Hino, Osaka (JP); Tsutomu Sato, Osaka (JP); Rio Otsuru, Osaka (JP); Keiko Nishimura, Osaka (JP); Ryo Iriguchi, Osaka (JP)

(73) Assignee: Nippon Seal Co., Ltd., Osaka (JP)

( * ) Notice: Subject to any disclaimer, the term of this patent is extended or adjusted under 35 U.S.C. 154(b) by 710 days.

(21) Appl. No.: 17/296,102

(22) PCT Filed: May 14, 2020

(86) PCT No.: PCT/JP2020/019222
§ 371 (c)(1),
(2) Date: May 21, 2021

(87) PCT Pub. No.: WO2020/230841
PCT Pub. Date: Nov. 19, 2020

(65) Prior Publication Data

US 2022/0007911 A1 Jan. 13, 2022

(30) Foreign Application Priority Data

May 16, 2019 (JP) ..... 2019-092564

(51) Int. Cl.
*A47L 11/22* (2006.01)
*A47L 11/33* (2006.01)

(52) U.S. Cl.
CPC ..... *A47L 11/22* (2013.01); *A47L 11/33* (2013.01)

(58) Field of Classification Search
CPC ..... A47L 11/22; A47L 11/33; A47L 13/00
See application file for complete search history.

(56) References Cited

U.S. PATENT DOCUMENTS 2,689,367 A 9/1954 Parker

FOREIGN PATENT DOCUMENTS

| | | | | |
|---|---|---|---|---|
| CN | 201365884 Y | * | 12/2009 | ..... A46B 13/001 |
| GB | 864972 A | | 4/1961 | |
| JP | S51-15569 | | 7/1974 | |
| JP | S53-106902 | | 2/1978 | |
| JP | H6-70870 A | | 8/1992 | |
| JP | 3009211 U | | 9/1994 | |
| KR | 101569906 B1 | * | 11/2015 | |
| WO | 2018-003047 A1 | | 1/2018 | |

OTHER PUBLICATIONS

International Search Report and Written Opinion filed in PCT/JP2020/019222, dated Jul. 21, 2020; 7 pages.

* cited by examiner

*Primary Examiner* — Randall E Chin
(74) *Attorney, Agent, or Firm* — Vedder Price P.C.

(57) ABSTRACT

The present invention includes a roller brush provided in a frame main body. The roller brush includes a rigid shaft, a pair of guide rollers, which are arranged concentrically with a shaft center line of the rigid shaft, and are mounted to shaft ends of the rigid shaft, and a cleaning brush cloth including cut piles raised from a cloth front surface of a foundation cloth. The cleaning brush cloth is helically wound around a shaft outer-peripheral surface of the rigid shaft with a cloth back surface of the foundation cloth being in contact with the shaft outer-peripheral surface, and is fixed to the rigid shaft.

1 Claim, 18 Drawing Sheets

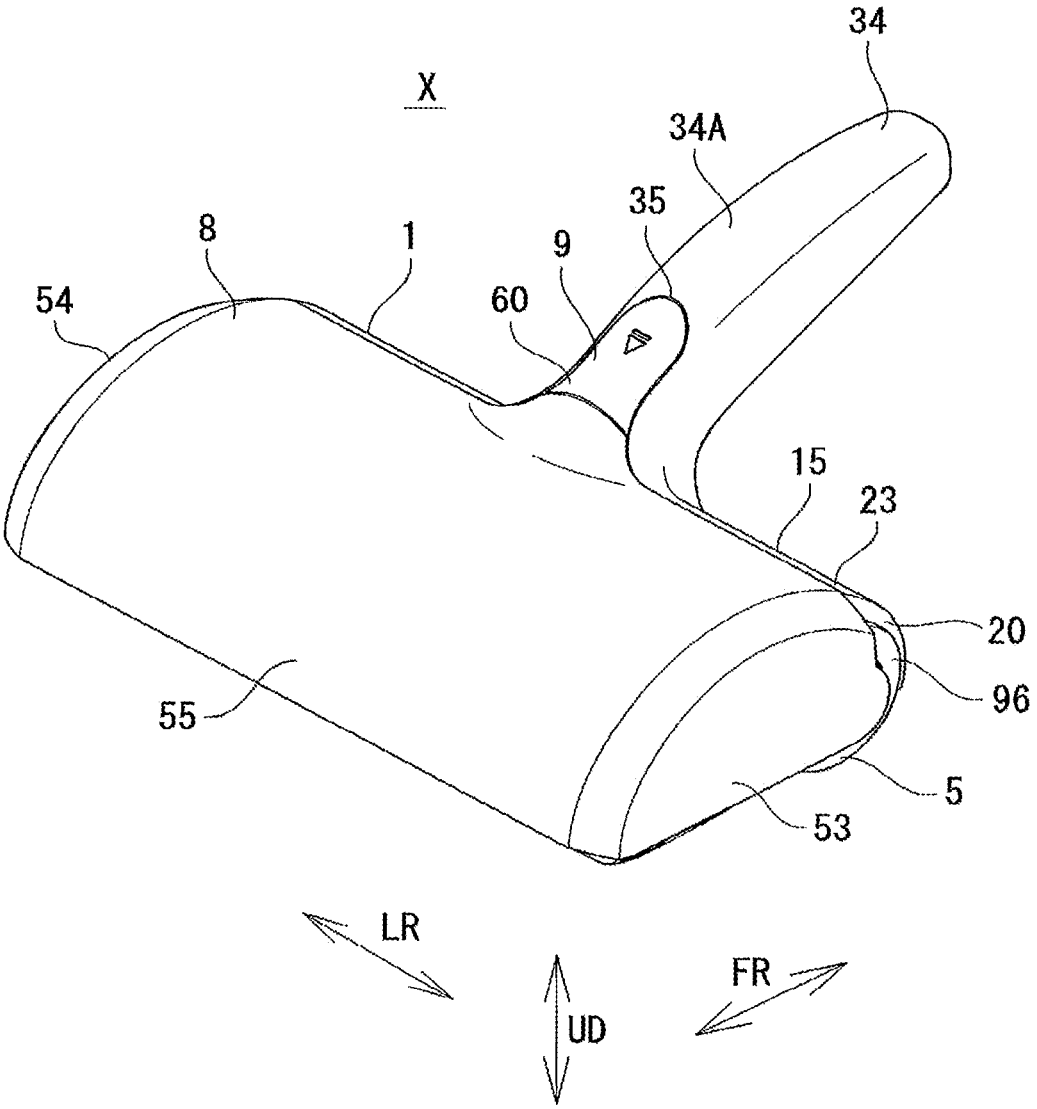
[FIG 1]

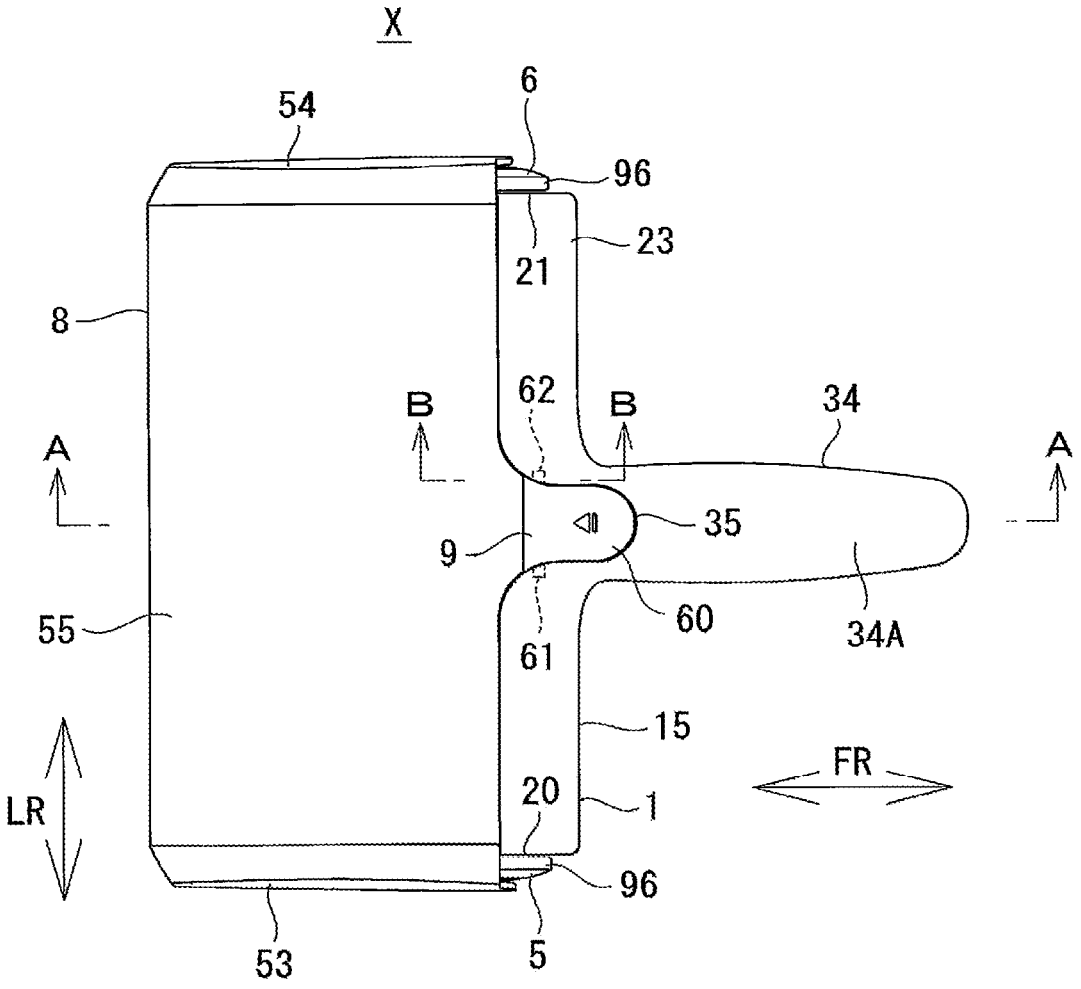
[FIG. 2]

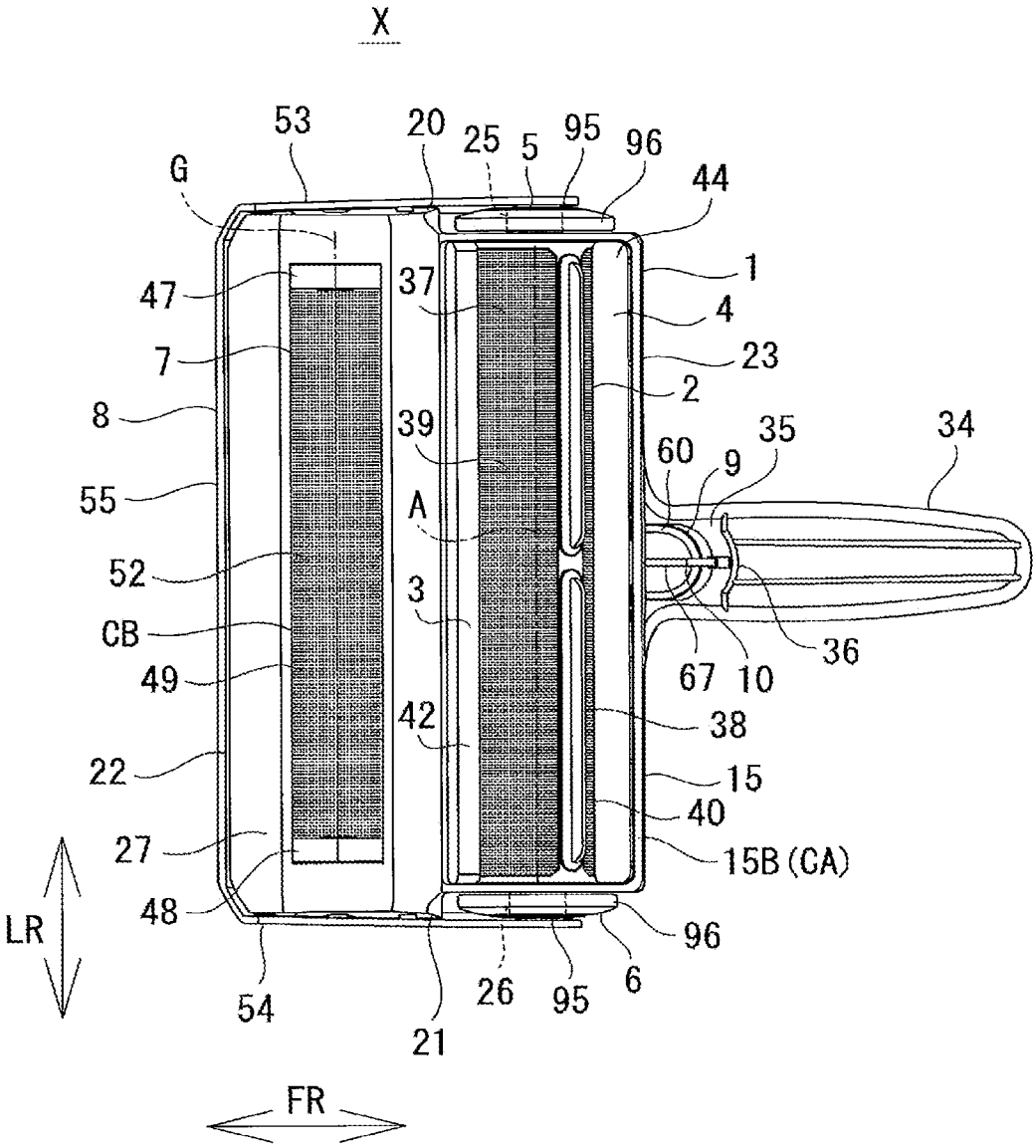
[FIG. 3]

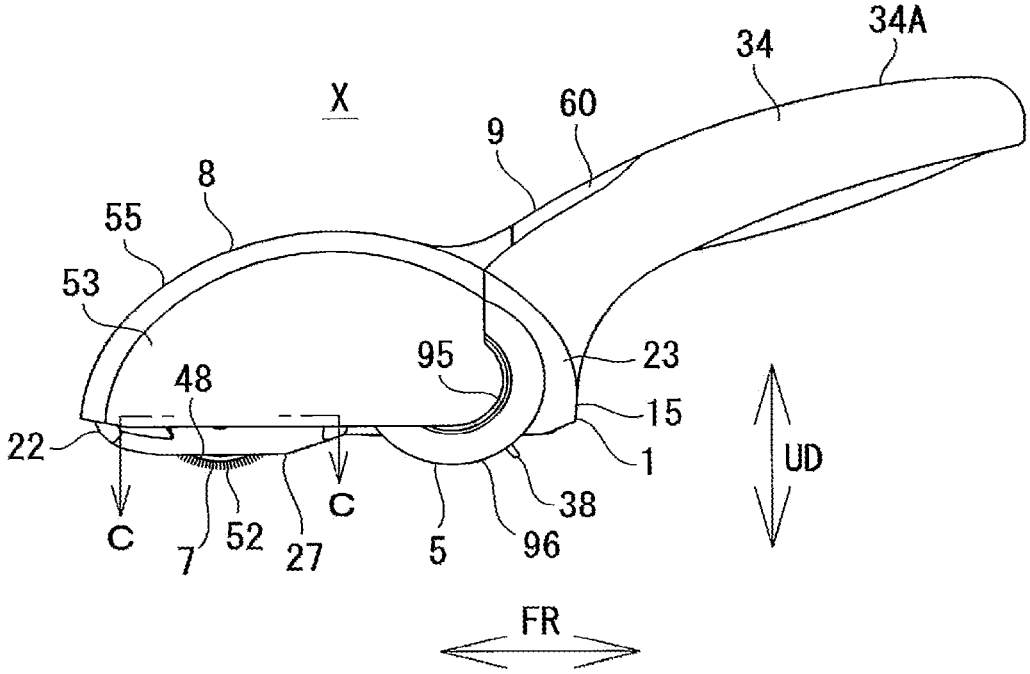
[FIG. 4]

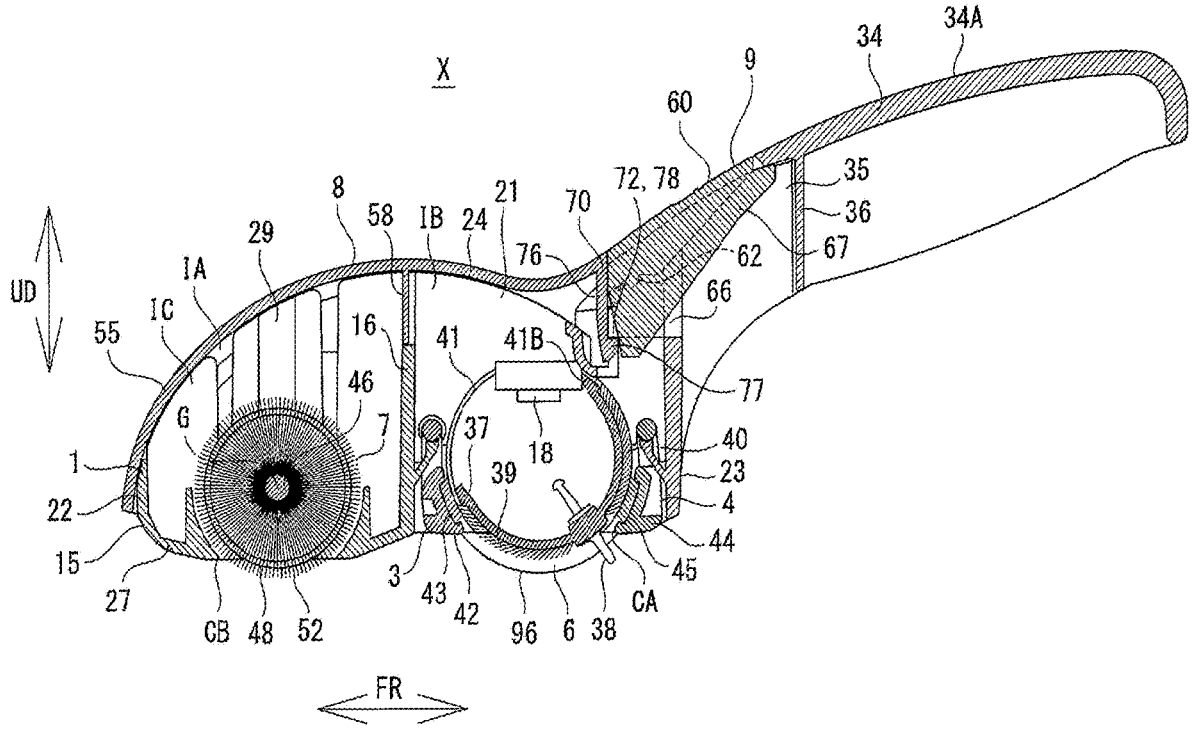
[FIG. 5]

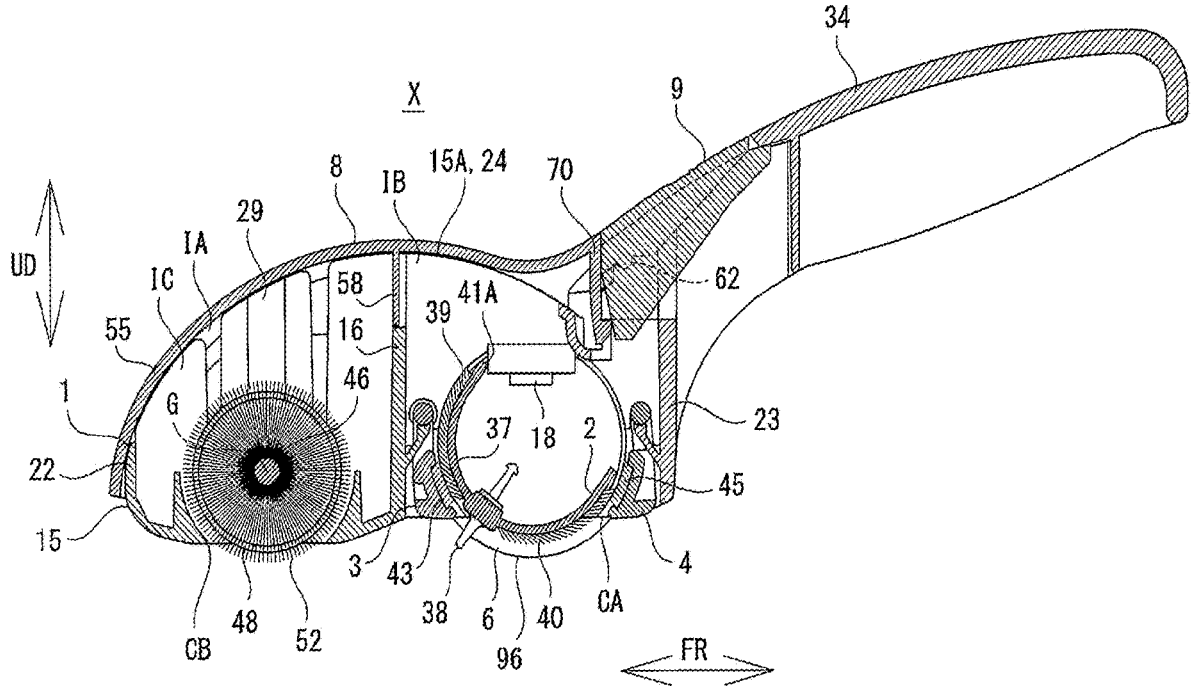
[FIG. 6]

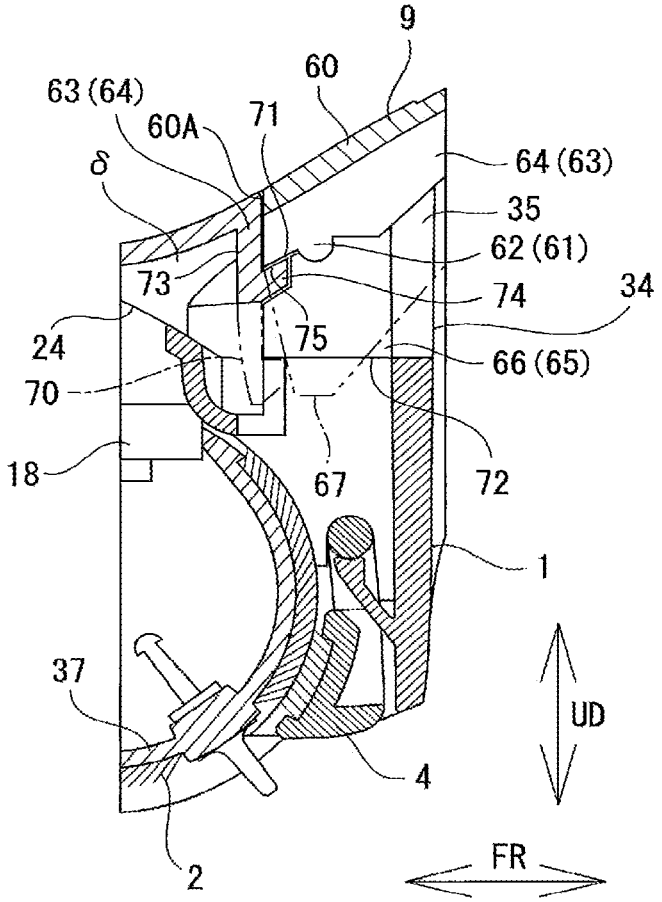
[FIG. 7]

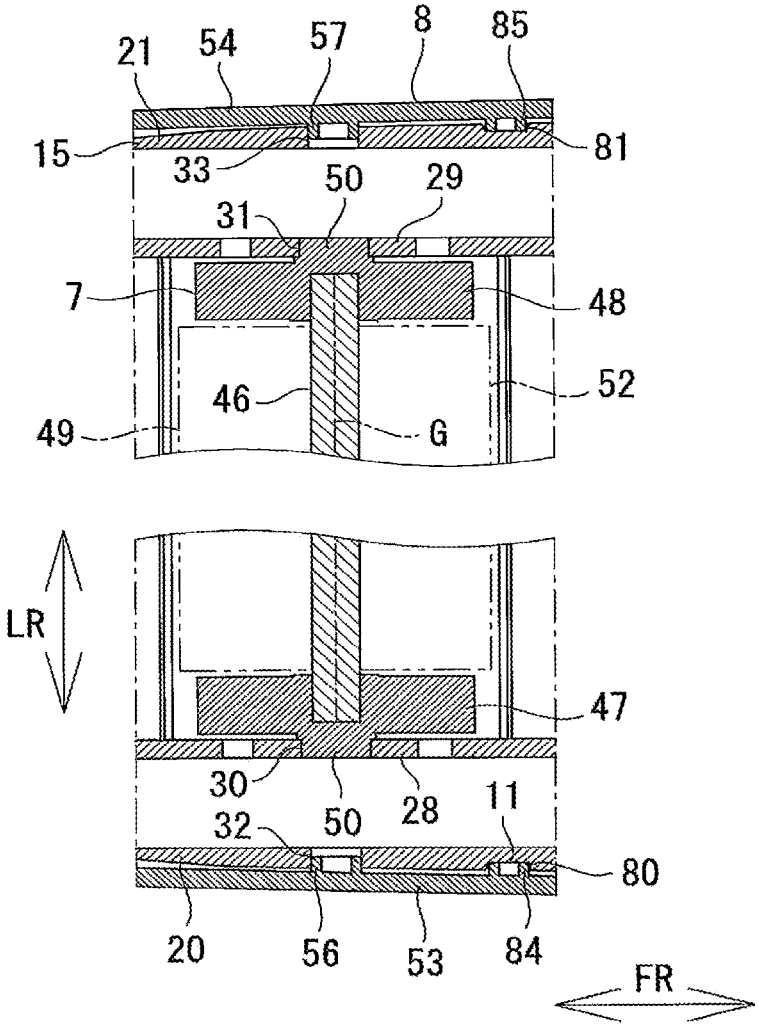
[FIG. 8]

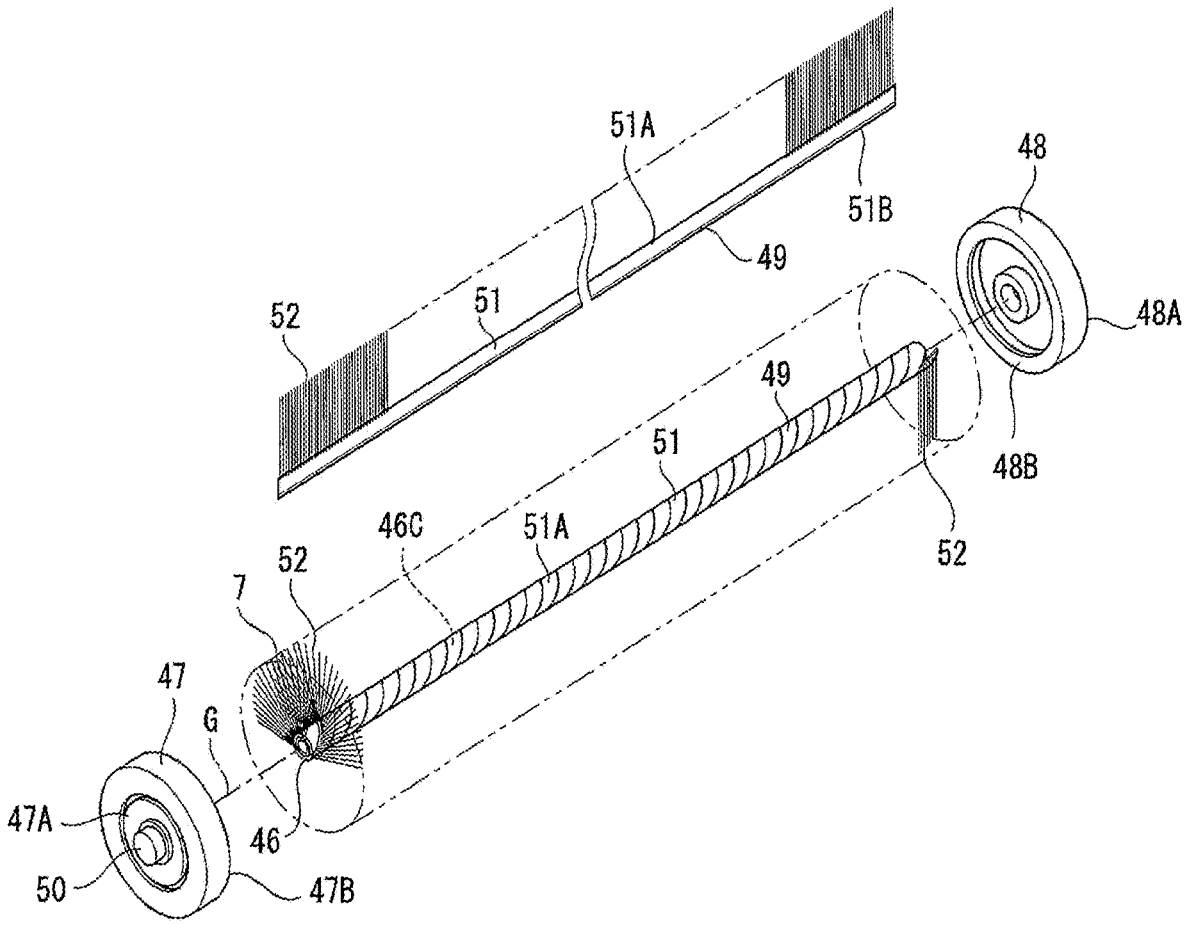
[FIG. 9]

(a)
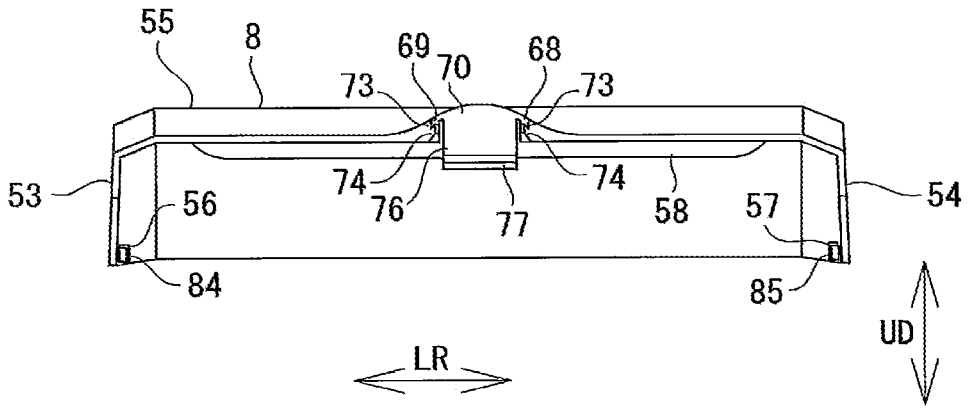
(b)
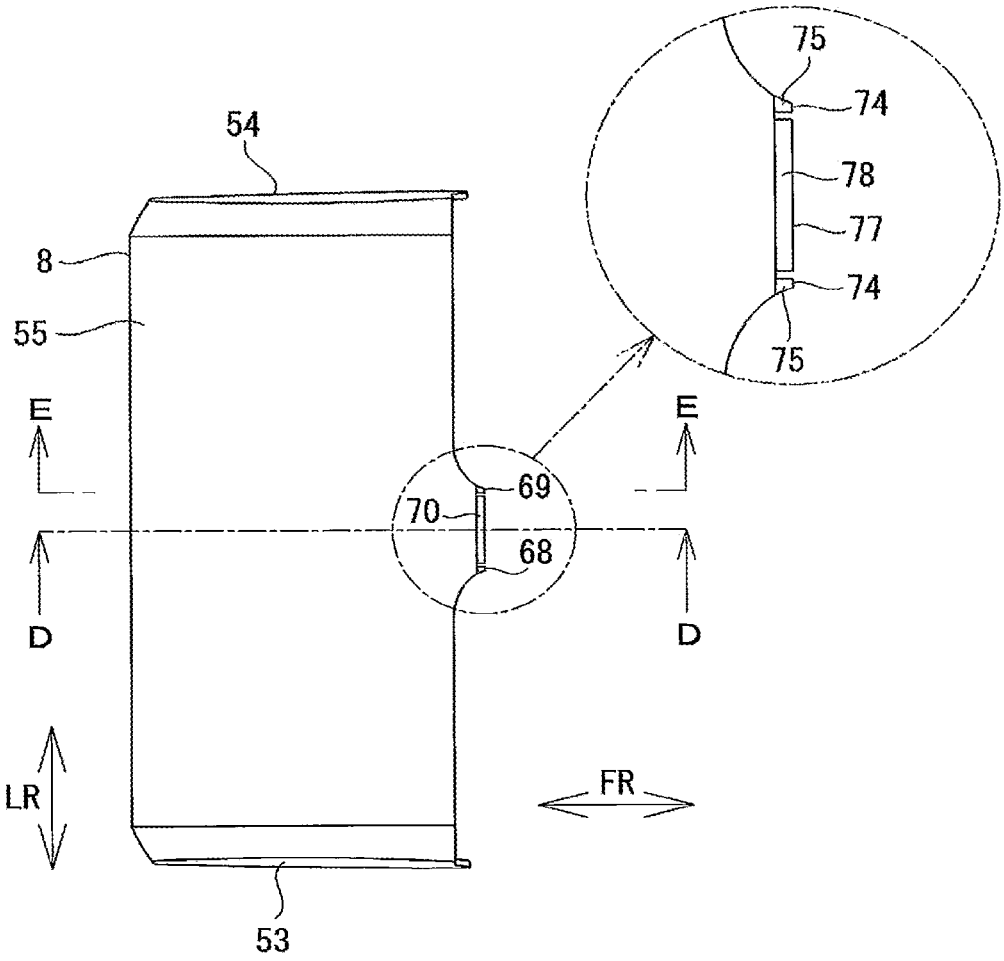
[FIG. 10]

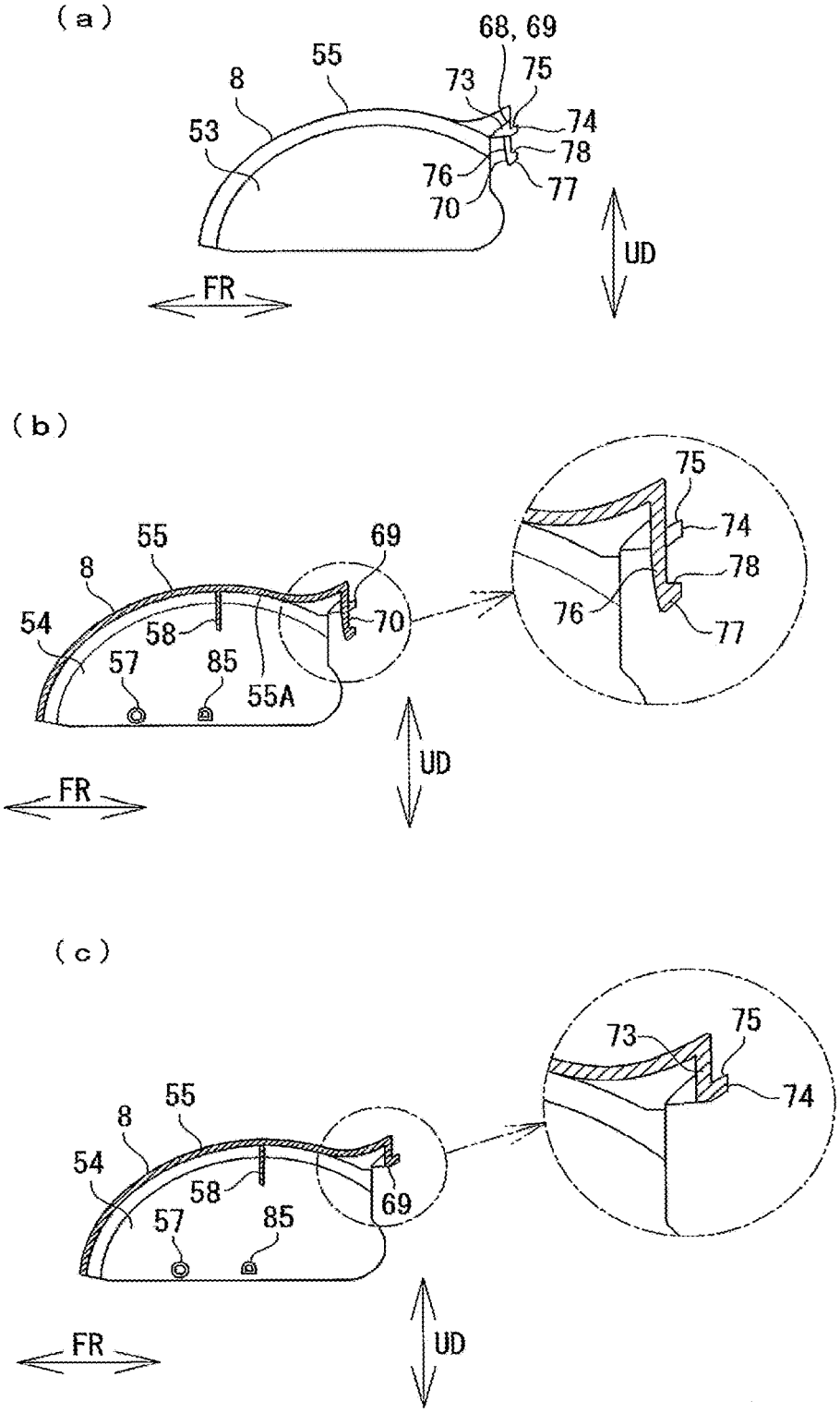
[FIG. 11]

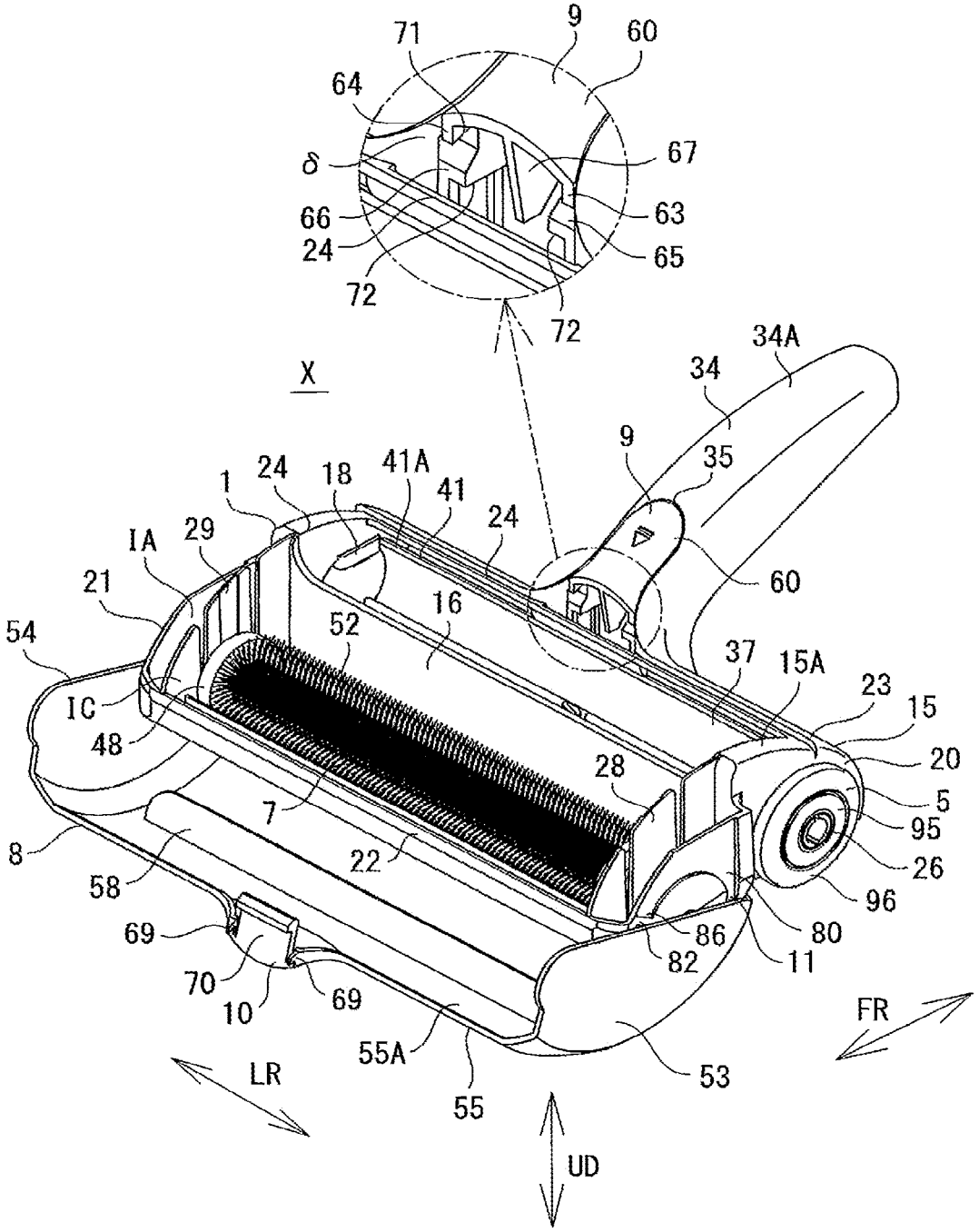
[FIG. 12]

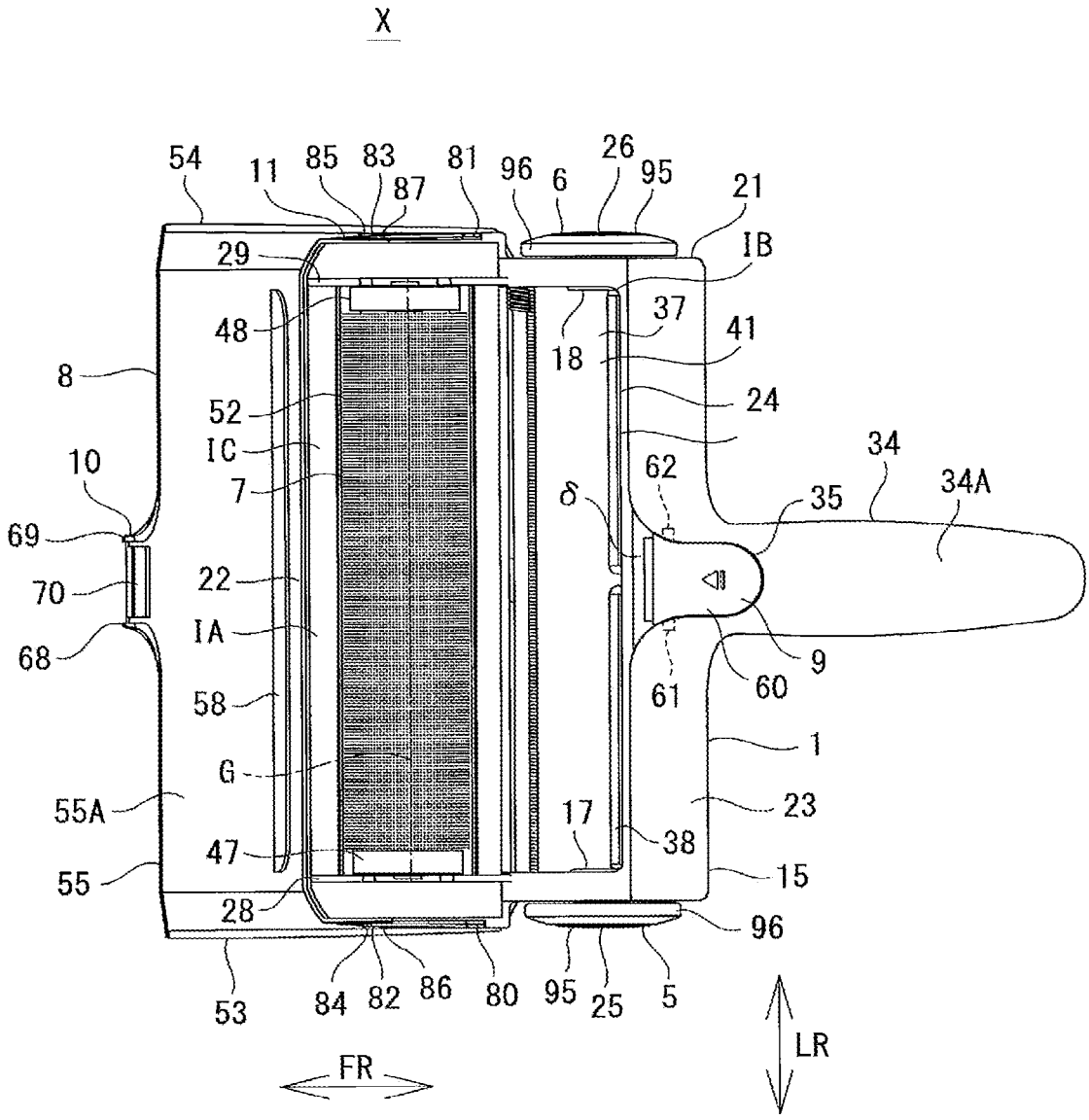
[FIG. 13]

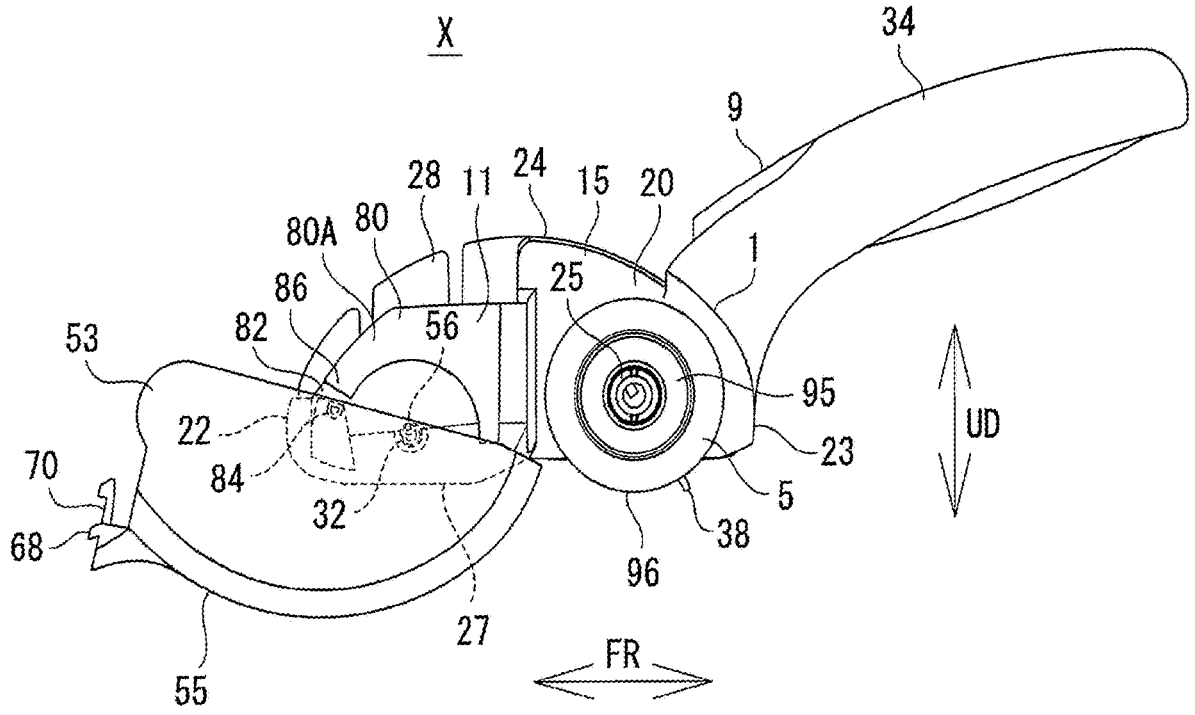
[FIG. 14]

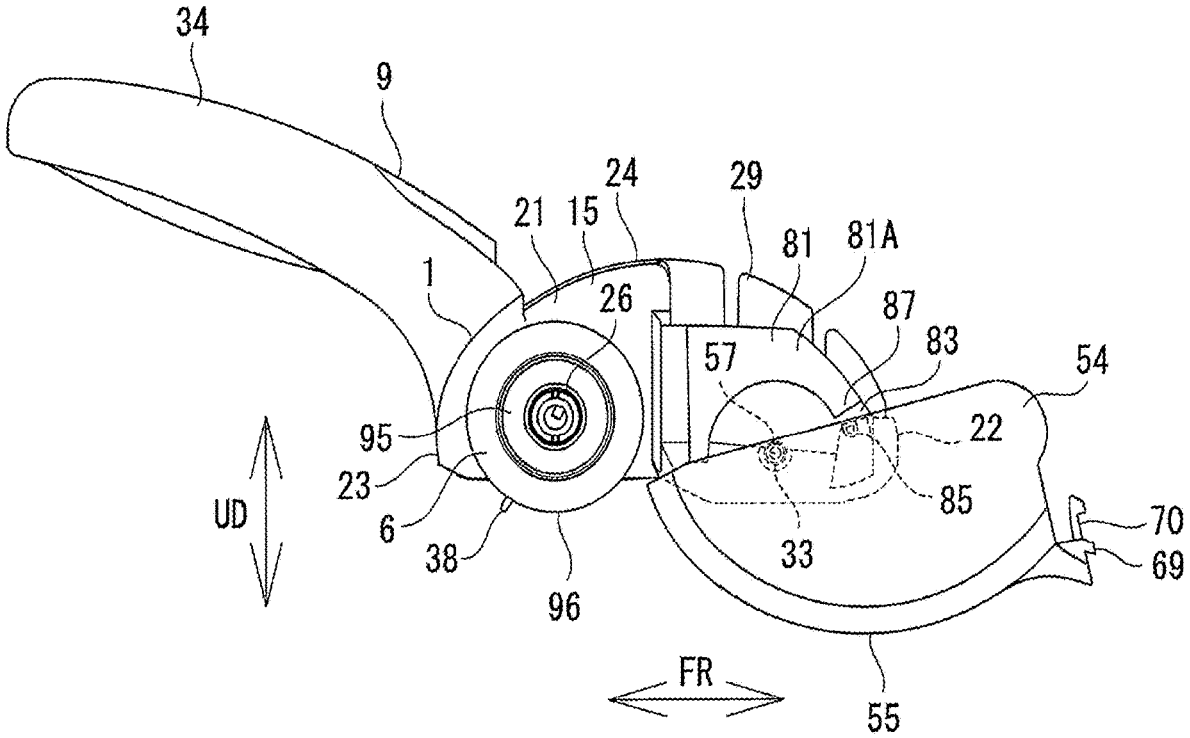
[FIG. 15]

(a)
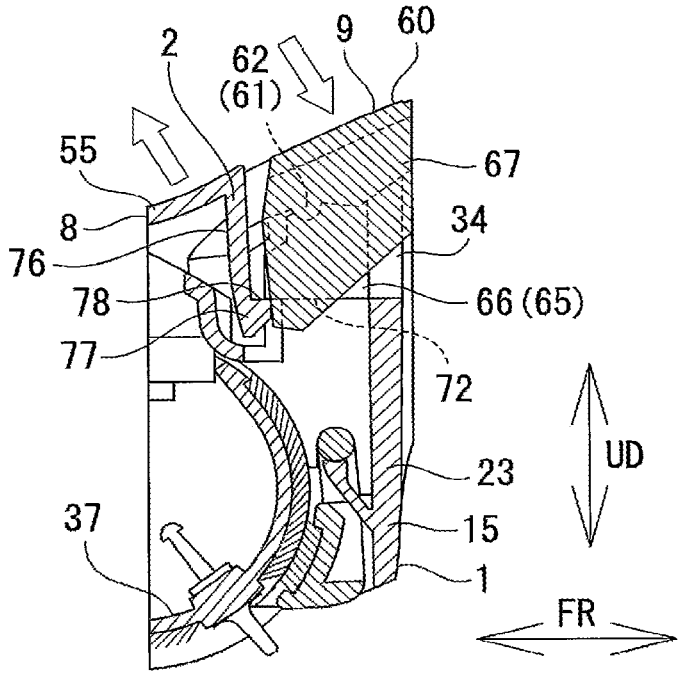
(b)
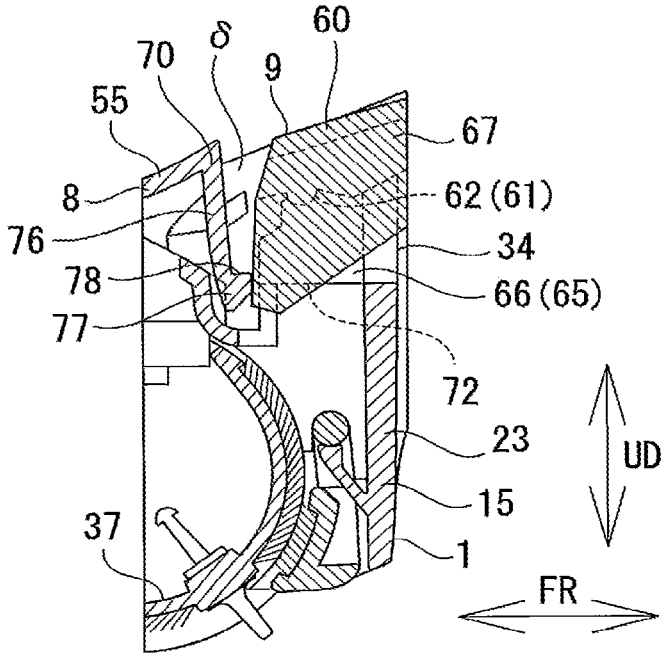
[FIG. 16]

(a)
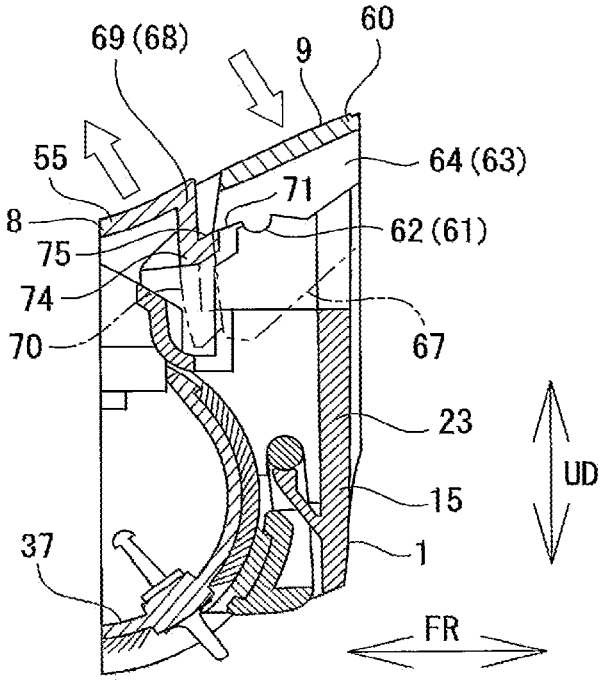
(b)
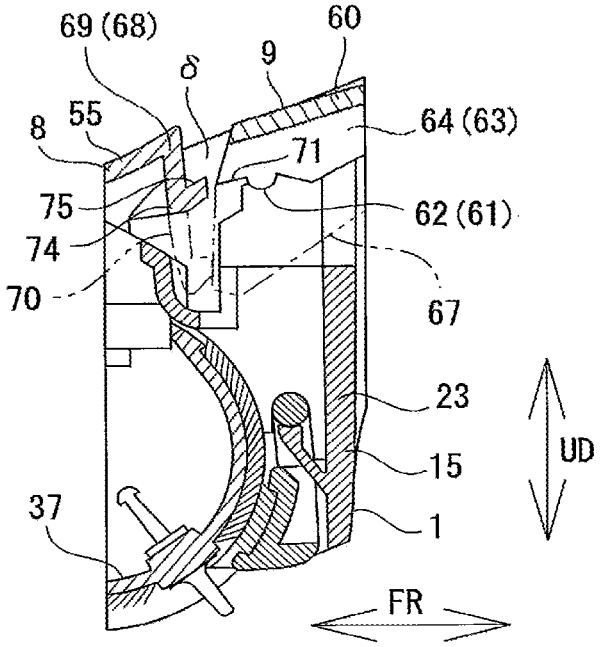
[FIG. 17]

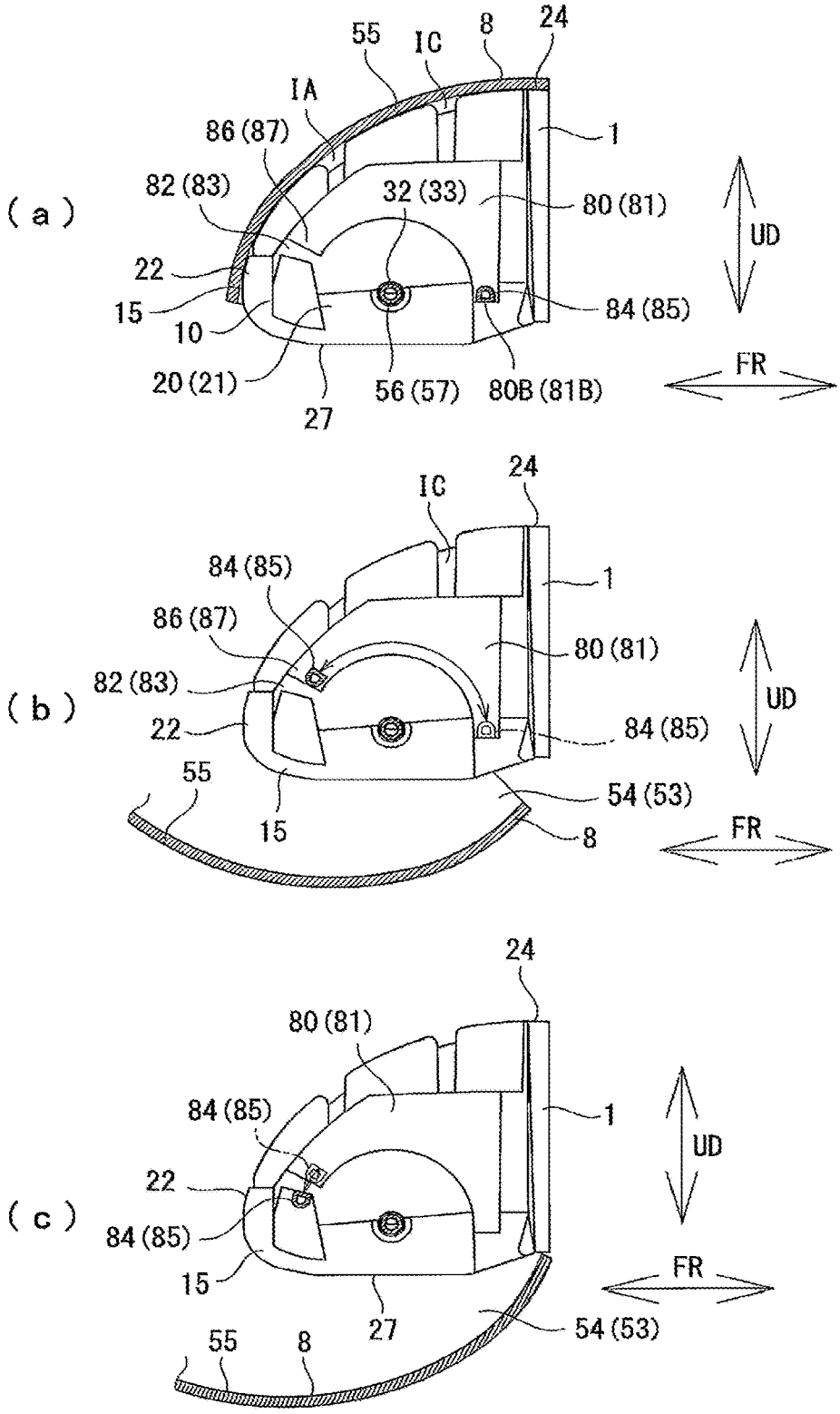
[FIG. 18]

MANUAL CLEANING TOOL

TECHNICAL FIELD

The present invention relates to a manual cleaning tool to be used for cleaning of, for example, a carpet, a tatami mat, a wooden floor, a sofa, a chair, and a vehicle interior of an automobile.

BACKGROUND ART

A manual cleaning tool is disclosed in Patent Literature 1 as a technology of cleaning, for example, a carpet. The manual cleaning tool includes a roller brush and a slant bristle brush, which are supported in a casing. The roller brush is removably and pivotably supported by a pair of support portions. The roller brush is formed by implanting bristles into a core member formed of wires. Rolling wheels are provided at both end portions of the core member.

CITATION LIST PATENT LITERATURE

[PTL 1] JP 2004-329618 A

SUMMARY OF INVENTION

Technical Problem

In Patent Literature 1, the core member is formed of wires. Thus, when the wires of the roller brush are gripped and pulled up to be removed from the support portions, plastic deformation (permanent deformation) such as bending of the wires may occur.

The present invention has an object to provide a manual cleaning tool capable of suppressing plastic deformation (permanent deformation) such as bending when a roller brush is removed.

The present invention has an object to provide a manual cleaning tool capable of maintaining a closed state and an open state of a lid.

Solution to Problem

In an embodiment of the present invention, a manual cleaning tool is provided, which includes: a casing including a frame main body having a right wall plate and a left wall plate arranged in a right direction and a front wall plate and a rear wall plate arranged in a front-and-rear direction, which define an internal space, the casing having a discharge port defined by upper ends of the wall plate in an up-and-down direction; a pair of roller wheels pivotably mounted to the frame main body; a roller brush provided inside the casing; and a lid pivotably mounted to the frame main body and configured to open and close the discharge port. The roller wheels are arranged such that wheel outer-peripheral surfaces of the roller wheels project beyond lower ends of the wall plate in the up-and-down direction, and are pivotably supported by the right wall plate and the left wall plate from an outer side of the frame main body. The roller brush includes: a rigid shaft; a pair of guide rollers arranged concentrically with a shaft center line of the rigid shaft and mounted to shaft ends of the rigid shaft; a cleaning brush cloth including a foundation cloth and cut piles raised from a cloth front surface of the foundation cloth wound helically around a shaft outer-peripheral surface of the rigid shaft such that a cloth back surface of the foundation cloth is in contact with the shaft outer-peripheral surface and fixed to the rigid shaft such that distal ends of the cut piles project beyond outer-peripheral surfaces of the guide rollers. The roller brush is provided inside the casing with the shaft center line of the rigid shaft being matched with the left-and-right direction and part of the cut piles of the cleaning brush cloth and part of each of the guide rollers projecting beyond the lower ends of the wall plates The roller brush is removable from the frame main body under an elastically deformed state of the rigid shaft, and the shaft ends of the rigid shaft are pivotably supported by the frame main body.

In an embodiment, the following configuration may also be employed. The rigid shaft may be a brush shaft. The roller brush may be removable from the frame main body by elastically deforming the rigid shaft (brush shaft), and the shaft ends of the rigid shaft (brush shaft) may be pivotably supported by the frame main body.

In another embodiment of the present invention, the casing includes a handle formed on the rear wall plate to be located at a center in a direction of the shaft center line of the rigid shaft and extends rearward in the front-and-rear direction from the rear wall plate.

In another embodiment of the present invention, the lid includes: a right lid plate and a left lid plate arranged in the left-and-right direction; an upper lid plate arranged between the right lid plate and the left lid plate and formed integrally with the right lid plate and the left lid plate; a first-lid pivot shaft projecting leftward in the left-and-right direction from the right lid plate; and a second-lid pivot shaft projecting rightward in the left-and-right direction from the left lid plate. The lid is mounted to the frame main body with the right lid plate being located on an outer side of the right wall plate, the left wall plate being located on an outer side of the left wall plate, the first-lid pivot shaft being pivotably supported by the right wall plate, and the second-lid pivot shaft being pivotably supported by the left wall plate. The upper lid plate covers the front wall plate and the discharge port and is in abutment against the upper ends of the right wall plate and the left wall plate under a closed state of the discharge port. The right wall plate and the left wall plate are located on the outer side of the roller wheels under the closed state, and cover part of the right wall plate and the left wall plate under an open state of the discharge port.

In another embodiment, the following configuration may be employed. The right lid plate and the left wall plate cover part of the right wall plate and part of the left wall plate under the open state of the discharge port.

In another embodiment of the present invention, the manual cleaning tool further includes: an operation button provided in the handle; and a closed lid holder configured to hold the lid in the closed state of the discharge port. The closed lid holder is configured to allow the lid to pivot by pushing the lid in the closed state, in a direction of opening the discharge port along with an operation of the operation button.

In another embodiment of the present invention, the manual cleaning tool further includes an open-lid lid holder configured to hold the lid in an open state of the discharge port, and configured to allow the lid to pivot along with an action on the lid with a given rotational force in a direction of closing the discharge port in the open state.

In another embodiment of the present invention, each of the roller wheels includes: a roller inner ring pivotably mounted to each of the right wall plate and the left wall plate; and a roller outer ring mounted to an outer-peripheral surface of the roller inner ring such that the roller inner ring and the roller outer ring, which is formed of an elastic body containing a synthetic rubber, form an integral body.

Advantageous Effects of Invention

In an embodiment, when the roller brush is removed from the frame main body, occurrence of plastic deformation (permanent deformation) such as bending of the rigid shaft can be suppressed.

In an embodiment, when the roller wheels and the guide rollers are brought into contact with a target to be cleaned, such as a carpet, a tatami mat, or a wooden floor, and the handle is gripped to reciprocate the casing (frame main body) in the front-and-rear direction, the roller brush is rotated forward and reverse to enable collection of dirt and dust in an internal space of the frame main body with a cleaning brush cloth (cut piles) fixed to the rigid shaft.

In an embodiment, when the lid is pivoted, the discharge port of the casing can be opened and closed.

In an embodiment, the roller brush (cut piles) is pressed against the target to be cleaned during cleaning. As a result, even when a force (rotational force) in a direction of opening the discharge port acts on the lid in a closed state, the closed state of the lid can be maintained by the closed lid holder.

In an embodiment, the open state of the lid is maintained by the open-lid lid holder. As a result, the discharge port is directed downward in the up-and-down direction to allow the collected dirt and dust to be discharged from the internal space without causing the lid to be closed.

In an embodiment, the outer-peripheral surface of each of the roller wheels is formed of an elastic body such as a synthetic rubber. Thus, damage to the target to be cleaned, which may be caused by the roller wheels, can be prevented.

BRIEF DESCRIPTION OF DRAWINGS

FIG. 1 is a perspective view for illustrating a manual cleaning tool under a closed state of a lid.

FIG. 2 is a top view for illustrating the manual cleaning tool under the closed state of the lid.

FIG. 3 is a bottom view for illustrating the manual cleaning tool under the closed state of the lid.

FIG. 4 is a right side view for illustrating the manual cleaning tool under the closed state of the lid.

FIG. 5 is a sectional view taken along the line A-A of FIG. 2 (when protruding pieces are located on a second dust-removal brush side).

FIG. 6 is a sectional view taken along the line A-A of FIG. 2 (when the protruding pieces are located on a first dust-removal brush side)

FIG. 7 is an enlarged sectional view taken along the line B-B of FIG. 2.

FIG. 8 is an enlarged partial sectional view taken along the line C-C of FIG. 4.

FIG. 9 is a perspective view for illustrating a roller brush.

FIG. 10(*a*) is a front view for illustrating the lid, and first and second claws, and FIG. 10(*b*) is a top view for illustrating the lid, and the first and second claws.

FIG. 11(*a*) is a right side view for illustrating the lid, and the first and second claws, FIG. 11(*b*) is a sectional view taken along the line D-D of FIG. 10(*b*), and FIG. 11(*c*) is a sectional view taken along the line E-E of FIG. 10(*b*).

FIG. 12 is a perspective view for illustrating the manual cleaning tool under an open state of the lid.

FIG. 13 is a top view for illustrating the manual cleaning tool under the open state of the lid.

FIG. 14 is an enlarged right side view for illustrating the manual cleaning tool under the open state of the lid.

FIG. 15 is an enlarged left side view for illustrating the manual cleaning tool under the open state of the lid.

FIG. 16 are enlarged partial sectional views taken along the line A-A of FIG. 2, for illustrating operations of a push plate, the second claw, and each of handle stopping protrusions.

FIG. 17 are enlarged sectional views taken along the line B-B of FIG. 2, for illustrating operations of each of the first claws and each of button-stop protrusions.

FIG. 18 are side views for illustrating opening and closing operations of the lid.

DESCRIPTION OF EMBODIMENT

A manual cleaning tool according to the present invention is described with reference to FIG. 1 to FIG. 18.

In FIG. 1 to FIGS. 18, a manual cleaning tool X includes a casing 1, a dust-catch brush 2, a first dust-removal brush 3, a second dust-removal brush 4, a pair of right and left roller wheels 5 and 6, a roller brush 7, a lid 8, an operation button 9, a closed lid holder 10, and an open-lid lid holder 11.

As illustrated in FIG. 1 to FIG. 5 and FIG. 12 to FIG. 14, the casing 1 includes a frame main body 15, a partition wall 16, and a pair of right and left stopper pieces 17 and 18.

The frame main body 15, the partition wall 16, and the stopper pieces 17 and 18 of the casing 1 are made of, for example, a synthetic resin and formed integrally with each other.

As illustrated in FIG. 1 to FIG. 5 and FIG. 12 to FIG. 14, the frame main body 15 includes a right wall plate 20 (right wall) and a left wall plate 21 (left wall) in a left-and-right direction LR and a front wall plate 22 (front wall) and a rear wall plate 23 in a front-and-rear direction FR, which define an internal space IA. The frame main body 15 (casing 1) has a discharge port 24 defined by upper ends 15A of the wall plate 20 to 23 in an up-and-down direction UD.

The front-and-rear direction FR is orthogonal to the left-and-right direction LR, and the up-and-down direction UD is orthogonal to the left-and-right direction LR and the front-and-rear direction FR.

As illustrated in FIG. 5, FIG. 12, and FIG. 13, the partition wall 16 (partition wall plate) is provided between the right wall plate 20 and the left wall plate 21, and is formed integrally with the right wall plate 20 and the left wall plate 21.

In this manner, the partition wall 16 divides the internal space IA into a first dust-collection chamber IB on the rear wall plate 23 side and a second dust-collection chamber IC on the front wall plate 22 side.

As illustrated in FIG. 5, FIG. 12, and FIG. 13, the stopper pieces 17 and 18 are formed integrally with the frame main body 15. The stopper pieces 17 and 18 are formed on the right wall plate 20 and the left wall plate 21 so as to be spaced apart from each other in the left-and-right direction LR. The stopper pieces 17 and 18 project downward in the up-and-down direction UD, and are located in the first dust-collection chamber 1B.

As illustrated in FIG. 3 and FIG. 12 to FIG. 15, the casing 1 includes a pair of right and left wheel shafts 25 and 26.

The wheel shafts 25 and 26 are each formed in, for example, a cylindrical shape, and are formed integrally with a part of the right wall plate 20 on the rear wall plate 23 side and a part of the left wall plate 21 on the rear wall plate 23 side, respectively. The wheel shaft 25 projects outward (rightward) from the right wall plate 20, and the wheel shaft 26 projects outward (leftward) from the left wall plate 21.

As illustrated in FIG. 3, FIG. 5, FIG. 8, and FIG. 12 to FIG. 15, the casing 1 includes a bottom wall plate 27, a pair of right and left brush support plate 28 and 29, a pair of pivot-shaft holes 30 and 31, a pair of lid pivot-shaft holes 32 and 33, a second dust port CB, and a handle 34.

As illustrated in FIG. 3, the bottom wall plate 27 closes the second dust-collection chamber IC from below in the up-and-down direction UD, and is formed integrally with the partition wall 16, the right wall plate 20, the left wall plate 21, and the front wall plate 22.

As illustrated in FIG. 5, FIG. 8, FIG. 12, and FIG. 13, the brush support plate 28 and 29 are each formed of an elastic body (elastically deformable elastic body), which is made of, for example, a synthetic resin and is elastically deformable in the left-and-right direction LR. The brush support plate 28 and 29 are provided in the second dust-collection chamber IC. The brush support plate 28 and 29 are arranged side by side so as to be spaced apart from each other in the left-and-right direction LR.

The brush support plate 28 and 29 are formed integrally with the bottom wall plate 27, and extend upward in the up-and-down direction UD (toward the discharge port 24) from the bottom wall plate 27.

As illustrated in FIG. 8, the pivot-shaft holes 30 and 31 are formed in the brush support plate 28 and 29, respectively, in alignment with each other. The pivot-shaft holes 30 and 31 pass through the brush support plate 28 and 29 in the left-and-right direction LR, respectively.

As illustrated in FIG. 8, the lid pivot-shaft holes 32 and 33 are formed in a portion of the right wall plate 20 on the front wall plate 22 side and a portion of the left wall plate 21 on the front wall plate 22 side in alignment with each other. The lid pivot-shaft holes 32 and 33 pass through the right wall plate 20 and the left wall plate 21 in the left-and-right direction LR, respectively, and are open to the second dust-collection chamber IC.

As illustrated in FIG. 3, the second dust port CB is formed in the bottom wall plate 27 so as to be in communication with the second dust-collection chamber IC. The second dust port CB passes through the bottom wall plate 27 in the up-and-down direction UD to be open to the second dust-collection chamber IC.

As illustrated in FIG. 1 to FIG. 5, the handle 34 is provided at a position corresponding to a center between the brush support plate 28 and 29 in the left-and-right direction LR. The handle 34 is formed integrally with the rear wall plate 23. The handle 34 extends rearward in the front-and-rear direction FR from the rear wall plate 23.

As illustrated in FIG. 5, the handle 34 includes a button-accommodation hole 35 and a button-stop wall plate 36 (button-stop wall).

As illustrated in FIG. 5 and FIG. 12, the button-accommodation hole 35 is formed adjacent to the discharge port 24. The button-accommodation hole 35 extends rearward in the front-and-rear direction FR from the discharge port 24 side (rear wall plate 23 side), and passes through the handle 34 in the up-and-down direction UD to have an opening on an upper end 34A of the handle 34.

As illustrated in FIG. 3 and FIG. 3, the button-stop wall plate 36 is located in the button-accommodation hole 35, and is formed integrally with the handle 34. The button-stop wall plate 36 is provided inside the handle 34 so as to be spaced apart from the rear wall plate 23 (discharge port 24) in the front-and-rear direction UD. The button-stop wall plate 36 projects downward in the up-and-down direction UD.

As illustrated in FIG. 3, FIG. 5, FIG. 12, and FIG. 13, the dust-catch brush 2 is provided in the first dust-collection chamber IB. The dust-catch brush 2 includes a drum main body 37, protruding pieces 38, a first dust-catch brush 39, and a second dust-catch brush 40.

As illustrated in FIG. 5, FIG. 12, and FIG. 13, the drum main body 37 is formed in an imperfect cylindrical shape having a dust-collection port 41 extending in a direction of a cylinder center line A.

As illustrated in FIG. 3 and FIG. 5, each of the protruding pieces 38 is an elastic body, and is made of, for example, a synthetic rubber. The protruding pieces 38 are arranged at a center between one rim 41A and another rim 41B of the dust-collection port 41 in a circumferential direction of the drum main body 37, and are mounted to the drum main body 37.

The protruding pieces 38 protrude from an outer-peripheral surface of the drum main body 37 in a radially outward direction.

As illustrated in FIG. 5, the first dust-catch brush 39 is arranged between the one rim 41A of the dust-collection port 41 and the protruding pieces 38 in the circumferential direction of the drum main body 37, and is mounted to the outer-peripheral surface of the drum main body 37. The first dust-catch brush 39 includes a plurality of inclined piles (inclined cut piles) inclined toward the one rim 41A of the dust-collection port 41.

As illustrated in FIG. 5, the second dust-catch brush 40 is arranged between the another rim 41B of the dust-collection port 41 and the protruding pieces 38 in the circumferential direction of the drum main body 37, and is mounted to the outer-peripheral surface of the drum main body 37. The second dust-catch brush 40 includes a plurality of inclined piles (inclined cut piles) inclined toward the another rim 41B of the dust-collection port 41.

As illustrated in FIG. 3, FIG. 5, and FIG. 13, the dust-catch brush 2 is provided in the first dust-collection chamber IB with the cylinder center line A of the drum main body 37 being matched with the left-and-right direction LR. As illustrated in FIG. 5, the drum main body 37 is placed in such a manner that part of the outer-peripheral surface of the drum main body 37 (part of first and second dust-catch brushes 39 and 40) and the protruding pieces 38 project from a first dust port CA defined by lower ends 15B of the wall plate 20 to 23 in the up-and-down direction UD. The drum main body 37 is pivotably supported by the right wall plate 20 and the left wall plate 21 (frame main body 15).

As illustrated in FIG. 5 and FIG. 13, the stopper pieces 17 and 18 protrude from the dust-collection port 41 into the drum main body 37. The stopper pieces 17 and 18 are arranged so as be spaced apart from the rims 41A and 41B of the dust-collection port 41 in the circumferential direction of the drum main body 37.

As illustrated in FIG. 3 and FIG. 5, the first dust-removal brush 3 includes a first wiper main body 42 and a first dust-removal brush 43.

The first dust-removal brush 43 is mounted to the first wiper main body 42. The first dust-removal brush 43 includes a plurality of inclined piles (inclined cut piles) inclined in the same direction as that of the inclined piles of the first dust-catch brush 39. The first wiper main body 42 is provided between the drum main body 37 and the partition wall 16 in the front-and-rear direction FR, and is located in the first dust-collection chamber IB while the first dust-removal brush 43 is in pressure contact with the first dust-catch brush 39. The first wiper main body 42 extends in the left-and-right direction LR, and is rockably supported in the frame main body 15.

As illustrated in FIG. 3 and FIG. 5, the second dust-removal brush 4 includes a second wiper main body 44 and a second dust-removal brush 45.

The second dust-removal brush 45 is mounted to the second wiper main body 44. The second dust-removal brush 45 includes a plurality of inclined piles (inclined cut piles) inclined in the same direction as that of the inclined piles of the second dust-catch brush 40. The second wiper main body 44 is provided between the drum main body 37 (dust-catch brush 2) and the rear wall plate 23 in the front-and-rear direction FR, and is located in the first dust-collection chamber IB while the second dust-removal brush 45 is in pressure contact with the second dust-catch brush 40 (dust-catch brush 2). The second wiper main body 44 extends in the left-and-right direction LR, and is rockably supported in the frame main body 15.

As illustrated in FIG. 1 to FIG. 4 and FIG. 12, each of the roller wheels 5 and 6 has a roller inner ring 95 and a roller outer ring 96. The roller inner ring 95 is made of, for example, a synthetic resin.

The roller outer ring 96 is formed of, for example, an elastic body containing a synthetic rubber. The roller outer ring 96 is mounted onto an outer-peripheral surface of the roller inner ring 95 so that the roller outer ring 96 and the roller inner ring 95 form an integral body.

The roller wheel 5 is arranged concentrically with the wheel shaft 25. The roller wheel 5 is mounted to the right wall plate 20 with a wheel outer-peripheral surface of the roller wheel 5 (outer-peripheral surface of the roller outer ring 96) being located between the outer-peripheral surface of the drum main body 37 and distal ends of the protruding pieces 38. The roller wheel 5 is pivotably mounted to the right wall plate 20 by fitting the roller inner ring 95 over the wheel shaft 25 so that the roller inner ring 95 faces an outer side of the right wall plate 20.

The roller wheel 6 is arranged concentrically with the wheel shaft 26. The roller wheel 6 is mounted to the left wall plate 21 with a wheel outer-peripheral surface of the roller wheel 6 (outer-peripheral surface of the roller outer ring 96) being located between the outer-peripheral surface of the drum main body 37 and distal ends of the protruding pieces 38. The roller wheel 6 is pivotably mounted to the left wall plate 21 of the frame main body 15 by fitting the roller inner ring 95 over the wheel shaft 26 so that the roller inner ring 95 faces an outer side of the left wall plate 21.

As illustrated in FIG. 9, the roller brush 7 includes a rigid shaft 46, a pair of right and left guide rollers 47 and 48, and a cleaning brush cloth 49.

As illustrated in FIG. 9, the rigid shaft 46 is a brush shaft. The rigid shaft 46 is made of, for example, a metal such as an aluminum alloy having rigidity, and is formed in a cylindrical shape (or to have a circular cross section).

As illustrated in FIG. 9, each of the guide rollers 47 and 48 has a roller-pivot shaft 50, and is made of, for example, a synthetic resin. The roller-pivot shafts 50 are arranged concentrically with the guide rollers 47 and 48 to project from wheel surfaces 47A and 48A, respectively.

The guide rollers 47 and 48 are arranged concentrically with a shaft center line G of the rigid shaft 46, and are pivotably mounted to shaft ends 46A and 46B of the rigid shaft 46 so that wheel back surfaces 47B and 48B face the shaft ends, respectively.

As illustrated in FIG. 9, the cleaning brush cloth 49 includes a foundation cloth 51 and a plurality of cut piles 52. The plurality of cut piles 52 are raised from a cloth front surface 51A (front surface) of the foundation cloth 51.

The foundation cloth 51 is formed by weaving warp yarns (not shown) arranged side by side in a weft direction P into each of weft yarns (not shown) arranged side by side in a warp direction Q.

The plurality of cut piles 52 are arranged between the warp yarns in the weft direction P. The cut piles 52 are woven into the foundation cloth 51 by W weave or V weave along the warp direction Q to form W-pile or V-pile.

The cut piles 52 are continuously woven into the foundation cloth 51 in one row, for example, in the weft direction P.

As illustrated in FIG. 9, the cleaning brush cloth 49 is provided between the guide rollers 47 and 48. One or a plurality of cleaning brush cloths 49 are helically wound around a shaft outer-peripheral surface 46C of the rigid shaft 46 so that a cloth back surface 51B (back surface) of the foundation cloth 51 is in contact therewith, and are fixed to the rigid shaft 46 with, for example, an adhesive.

As a result, the cleaning brush cloth 49 is formed in a circular shape with the cut piles 52 projecting beyond the outer-peripheral surfaces of the guide rollers 47 and 48.

As illustrated in FIG. 3, FIG. 8, FIG. 12, and FIG. 13, the roller brush 7 is provided in the second dust-collection chamber IC (in the casing 1) with the shaft center line G of the rigid shaft 46 being matched with the left-and-right direction LR and part of the cut piles 52 of the cleaning brush cloth 49 and part of each of the guide rollers 47 and 48 projecting beyond the lower ends 15B (second dust-collection port CB) of the wall plate 20 to 23.

The rigid shaft 46 and the guide rollers 47 and 48 of the roller brush 7 are inserted between the brush support plate 28 and 29 while the brush support plate 28 and 29 are being elastically deformed in the left-and-right direction LR. The rigid shaft 46 is pushed downward in the up-and-down direction UD to insert the pivot shafts 50 of the guide rollers 47 and 48 into the pivot-shaft holes 30 and 31, respectively. In this manner, the roller brush 7 is pivotably supported by the brush support plate 28 and 29.

For removal of the roller brush 7, one brush support plate 28 is elastically deformed outward in the left-and-right direction LR. The rigid shaft 46 is pulled upward in the up-and-down direction UD. The pivot shafts 50 of the guide rollers 47 and 48 are removed from the pivot-shaft holes 30 and 31. In this manner, the roller brush 7 is removed from the brush support plate 28 and 29 (frame main body 15).

In this manner, the roller brush 7 is removable from the brush support plate 28 and 29 (frame main body 15). The shaft ends 46A and 46B of the rigid shaft 46 are pivotably supported by the brush support plate 28 and 29 (frame main body 15), respectively.

Further, the handle 34 is provided at the center in the direction of the shaft center line G of the rigid shaft 46.

The lid 8 is pivotably mounted to the frame main body 15, and is configured to open and close the discharge port 24. As illustrated in FIG. 1, FIG. 5, FIG. 10, and FIG. 11, the lid 8 includes a right lid plate 53 and a left lid plate 54 in the left-and-right direction, an upper lid plate 55, a first-lid pivot shaft 56, a second-lid pivot shaft 57, and a lid partition plate 58.

The upper lid plate 55 is provided between the right lid plate 53 and the left lid plate 54, and is formed integrally with the right lid plate 53 and the left lid plate 54. The upper lid plate 55 is formed in, for example, an arc-like shape projecting upward in the up-and-down direction UD.

The first-lid pivot shaft 56 is formed on a front part of the right lid plate 53 in the front-and-rear direction FR, and is formed integrally with the right lid plate 53. The first-lid pivot shaft 56 projects leftward in the left-and-right direction LR from an inner plate surface (back plate surface) of the right lid plate 53.

The second-lid pivot shaft 57 is formed on a front part of the left lid plate 54 in the front-and-rear direction FR, and is formed integrally with the left lid plate 54. The second-lid pivot shaft 57 is arranged concentrically with the first-lid pivot shaft 56, and projects rightward in the left-and-right direction LR from an inner plate surface (back plate surface) of the left lid plate 54.

The lid partition plate 58 is formed integrally with the upper lid plate 55. The lid partition plate 58 is formed to project downward in the up-and-down direction UD from an inner plate surface SSA (back plate surface) of the upper lid plate 55.

As illustrated in FIG. 1 to FIG. 3, the right lid plate 53 of the lid 8 is located on an outer side of the right wall plate 20. The right lid plate 53 is arranged so as to be spaced apart from the right wall plate 20 in the left-and-right direction LR.

The left lid plate 54 of the lid 8 is located on an outer side of the left wall plate 21. The left lid plate 54 is arranged so as to be spaced apart from the left wall plate 21 in the left-and-right direction LR.

As illustrated in FIG. 8, the first-lid pivot shaft 56 is inserted into the lid pivot-shaft hole 32 from an outer side of the right wall plate 20 so that the lid 8 is pivotably supported in the right wall plate 20. The second-lid pivot shaft 57 is inserted into the lid pivot-shaft hole 33 from an outer side of the left wall plate 21 so that the lid 8 is pivotably supported in the left wall plate 21.

As illustrated in FIG. 1 and FIG. 12, when being pivoted (rocked) about the first and second-lid pivot shafts 56 and 57 as a center of pivot, the lid 8 is brought into a closed state of the discharge port 24 (hereinafter referred to as "closed state") or an open state of the discharge port 24 (hereinafter referred to as "open state").

As illustrated in FIG. 5, under the closed state, the upper lid plate 55 covers the front wall plate 22 and the discharge port 24, and is in abutment against the upper end of the right wall plate 20, the upper end of the left wall plate 21, and upper ends of the brush support plate 28 and 29. Under the closed state, the upper lid plate 55 is located in front of the front wall plate 22, and extends toward a lower end of the front wall plate 22.

Under the closed state, the lid partition plate 58 is brought into abutment against the partition wall 16 from above in the up-and-down direction UD to completely isolate (close) the first dust-collection chamber IB and the second dust-collection chamber IC from each other in cooperation with the lid partition plate 58.

As illustrated in FIG. 1 to FIG. 4, under the closed state, the right lid plate 53 and the left lid plate 54 are located on outer sides of the roller wheels 5 and 6 to cover part of the roller wheel 5 and part of the roller wheel 6, respectively. As illustrated in FIG. 12 to FIG. 15, under the open state, the right lid plate 53 and the left lid plate 54 cover part of the right wall plate 20 and part of the left wall plate 21, respectively.

As illustrated in FIG. 2 and FIG. 13, the operation button 9 includes a button main body 60 and a pair of right-and-left button-pivot shafts 61 and 62.

The button-pivot shafts 61 and 62 are formed on a front part of the button main body 60 in the front-and-rear direction FR, and are formed integrally with the button main body 60. The button-pivot shaft 61 is formed to project rightward in the left-and-right direction LR from the button main body 60. The button-pivot shaft 62 is formed to project leftward in the left-and-right direction LR from the button main body 60.

As illustrated in FIG. 12 and FIG. 13, the button main body 60 is provided in the button-accommodation hole 35 so as to define a claw insertion space o on a front side in the front-and-rear direction FR. The button main body 60 is provided in the button-accommodation hole 35 with the button-pivot shafts 61 and 62 being directed in the left-and-right direction LR. The button-pivot shafts 61 and 62 are supported in the handle 34 so that the button main body 60 is pivotably supported in the handle 34.

The closed lid holder 10 holds the lid 8 in the closed state of the discharge port 24. The closed lid holder 10 pushes the lid 8, which is in the closed state, in a direction of opening the discharge port 24 in accordance with an operation of the operation button 9 to allow the lid 8 to pivot.

As illustrated in FIG. 5, FIG. 7, FIG. 10 to FIG. 12, the closed lid holder 10 includes a pair of right-and-left button-stop protrusions 63 and 64, a pair of right and left handle stopping protrusions 65 and 66, a push plate 67, a pair of right and left first claws 68 and 69, and a second claw 70.

As illustrated in FIG. 7 and FIG. 12, the button-stop protrusions 63 and 64 are provided between a front end 60A of the button main body 60 and the button-pivot shafts 61 and 62 in the front-and-rear direction FR. The button-stop protrusions 63 and 64 are formed on the button main body 60 so as to be spaced apart from each other in the left-and-right direction LR. Each of the button-stop protrusions 63 and 64 has a protrusion-stop inclined surface 71 at its lower end in the up-and-down direction UD. The protrusion-stop inclined surface 71 is inclined while extending downward in the up-and-down direction UD and forward in the front-and-rear direction FR from each of the button-pivot shafts 61 and 62.

As illustrated in FIG. 5 and FIG. 12, the handle stopping protrusions 65 and 66 are formed on the handle 34 so as to be located in the button-accommodation hole 35. Each of the handle stopping protrusions 65 and 66 are formed to project toward the discharge port 24 to define the claw insertion space i5 on the front side in the front-and-rear direction UD. The handle stopping protrusions 65 and 66 are formed to be located below the button-stop protrusions 63 and 64 in the up-and-down direction UD, respectively. The handle stopping protrusions 65 and 66 are arranged so as to be spaced apart from each other in the left-and-right direction LR.

Each of the handle stopping protrusions 65 and 66 has a protrusion-stop flat surface 72 at its lower end in the up-and-down direction UD. The protrusion-stop flat surface 72 is a flat surface extending in parallel to the left-and-right direction LR and the front-and-rear direction FR.

The push plate 67 is formed integrally with the button main body 60 so as to be located in the button-accommodation hole 35. Along with pivot of the button main body 60 (operation button 9), the push plate 67 is moved from the button-accommodation hole 35 to be brought into abutment against the handle 34 and the button-stop wall plate 36.

As illustrated in FIG. 5 and FIG. 12, the push plate 67 is provided at a position between the button-stop protrusions 63 and 64 and between the handle stopping protrusions 65 and 66 so as to be spaced apart from the button-stop protrusions 63 and 64 and the handle stopping protrusions 65 and 66.

The push plate 67 extends from the button main body 60 to a position corresponding to the handle stopping protrusions 65 and 66 in the up-and-down direction UD.

As illustrated in FIG. 7, FIG. 10, and FIG. 11, the first claws 68 and 69 are formed on the upper lid plate 55 so as to be located on a rear end side of the upper lid plate 55 in the front-and-rear direction LR. The first claws 68 and 69 are arranged so as to be spaced apart from each other in the left-and-right direction LR. As illustrated in FIGS. 10, the first claws 68 and 69 are formed on the right and left sides at equal distances from a center of the upper lid plate 55 in the left-and-right direction LR in alignment with each other. The first claws 68 and 69 are formed of elastic bodies made of, for example, a synthetic resin.

Each of the first claws 68 and 69 has a first claw support portion 73 (first claw support plate) and a first claw protrusion 74.

As illustrated in FIG. 7, FIG. 10, and FIG. 11, the first claw support portions 73 are formed integrally with the upper lid plate 55 so as to be supported by the upper lid plate 55 in a cantilever manner. The first claw support portions 73 are formed to project downward in the up-and-down direction UD from the upper lid plate 55.

As illustrated in FIG. 7, FIG. 10, and FIG. 11, the first claw protrusions 74 are formed to project rearward in the front-and-rear direction UD from lower ends of the first claw support portions 73. Each of the first claw protrusions 74 has a protrusion inclined surface 75 at its upper end in the up-and-down direction UD. The protrusion inclined surfaces 75 are abuttable against the protrusion-stop inclined surfaces 71 of the button-stop protrusions 63 and 64. Each of the protrusion inclined surfaces 75 is inclined while extending rearward in the front-and-rear direction FR and upward in the up-and-down direction UD from the first claw support portion 73.

As illustrated in FIG. 5, FIG. 10, and FIG. 11, the second claw 70 is formed on the upper lid plate 55 so as to be located on the rear end side of the upper lid plate 55 in the front-and-rear direction FR. The second claw 70 is located between the first claws 68 and 68. The second claw 70 is located at a center of the upper lid plate 55 in the left-and-right direction LR. The second claw 70 is formed of an elastic body made of, for example, a synthetic resin.

The second claw 70 has a second claw support portion 76 (second claw support plate) and a second claw protrusion 77.

As illustrated in FIG. 5, FIG. 10, and FIG. 11, the second claw support portion 76 is formed integrally with the upper lid plate 55 so as to be supported by the upper lid plate 55 in a cantilever manner. The second claw support portion 76 is formed to project (extend) from the upper lid plate 55 to a position below the first claws 68 and 68 (first claw protrusions 74) in the up-and-down direction UD.

As illustrated in FIG. 5, FIG. 1, and FIG. 11, the second claw protrusion 77 is formed to project rearward in the front-and-rear direction UD from a lower end of the second claw support portion 76 in the up-and-down direction UD.

The second claw protrusion 77 has a protrusion flat surface 78 at its upper end in the up-and-down direction UD. The protrusion flat surface 78 is abuttable against the protrusion-stop flat surfaces 72 of the handle stopping protrusions 65 and 66. The protrusion flat surface 78 is a flat surface extending in parallel to the left-and-right direction LR and the front-and-rear direction FR.

When the lid 8, which is in the open state, is rotated, the first claws 68 and 69 are inserted into the insertion space o as illustrated in FIG. 16(*b*) to bring the first claw protrusions 74 into abutment against the button-stop protrusions 63 and 64 in the closed lid holder 10. The second claw 70 is inserted into the claw insertion space as illustrated in FIG. 17(*b*) to bring the second claw protrusion 77 into abutment against the handle stopping protrusions 65 and 66 and the push plate 67.

Along with the rotation of the lid 8 to bring the lid 8 into the closed state, the first claws 68 and 69 are elastically deformed forward in the front-and-rear direction FR as illustrated in FIG. 7 by the abutment against the button-stop protrusions 63 and 64. Then, the protrusion inclined surfaces 75 are brought into abutment against the protrusion-stop inclined surfaces 71 of the button-stop protrusions 63 and 64 from below in the up-and-down direction UD. The second claw 70 is elastically deformed forward in the front-and-rear direction FR as illustrated in FIG. 5 by the abutment against the handle stopping protrusions 65 and 66 to be brought into abutment against the protrusion-stop flat surfaces 72 of the handle stopping protrusions 65 and 66 from below in the up-and-down direction UD.

In this manner, the closed lid holder 10 disables the rotation of the lid 8, which is in the open state, in an opening direction to hold the lid 8 in the closed state.

Along with the rotation of the lid 8 to bring the lid 8 into the open state, the second claw protrusion 77 of the second claw 70 is brought into abutment against the push plate 67 to push the push plate 67 rearward in the front-and-rear direction FR to thereby rotate the button main body 60. The push plate 67 is rotated together with the button main body 60 to be brought into abutment against the handle 34.

As a result, the rotation of the button main body 60 is stopped to position the button main body 60 at a button closed position P1 at which the button main body 60 is flush with the upper end 34A (upper surface) of the handle 34 (button closed position P1 on the upper end 34A side of the handle 34).

The button main body 60 at the button closed position P1 is pushed downward in the up-and-down direction UD to be rotated downward in the up-and-down direction UD.

As illustrated in FIG. 16(*a*), the push plate 67 is pressed against the second claw protrusion 77 of the second claw 70 along with the downward rotation (rotation in one direction) of the button main body 60. As a result, the push plate 67 pushes the lid 8, which is in the closed state, in the direction of opening the discharge port 24 to elastically deform the second claw 70 (the second claw support portion 76 and the second claw protrusion 77) forward in the front-and-rear direction UD and downward in the up-and-down direction UD.

As a result, as illustrated in FIG. 16(*b*), the push plate 67 separates the protrusion flat surface 78 of the second claw 70 from the protrusion-stop flat surfaces 72 of the handle stopping protrusions 65 and 66 to thereby move (separate) the second claw 70 into a second claw insertion space 62.

As illustrated in FIG. 17(*a*), along with the rotation of the button main body 60 in the one direction, the button-stop protrusions 63 and 64 turn upward in the up-and-down direction UD to separate the protrusion-stop inclined surfaces 71 from the protrusion inclined surfaces 75 of the first claws 68 and 69. Along with the forward pushing of the second claw 70, the push plate 67 moves the first claws 68 and 69 (lid 8) in a direction of opening the discharge port 24. As a result, as illustrated in FIG. 17(*b*), the protrusion inclined surfaces 75 of the first claws 68 and 69 are separated from the first protrusion-stop inclined surfaces 71 of the button-stop protrusions 63 and 64 by the rotation of the button main body 60 in the one direction and the pushing of the second claw 70 with the push plate 67 to thereby place (move) the first claws 68 and 69 in the insertion space o. As described above, along with the operation of the operation button 9 (button main body 60), the closed lid holder 10 allows the lid 8 to pivot.

The open-lid lid holder 11 holds the lid 8, which is in the open state of the discharge port 24. Along with an action on the lid 8, which is in the open state, with a given rotational force in a direction of closing the discharge port 24, the open-lid lid holder 11 allows the lid 8 to pivot.

As illustrated in FIG. 8, FIG. 10 to FIG. 15, the open-lid lid holder 11 has first and second guide arc-shaped grooves 80 and 81, first and second stopping protrusions 82 and 83, and first and second guide protrusions 84 and 85.

As illustrated in FIG. 14, the first guide arc-shaped groove 80 is formed in the right wall plate 20 to be located between the roller wheel 5 and the front wall plate 22 in the front-and-rear direction UD. The first guide arc-shaped groove 80 is formed concentrically with the first-lid pivot shaft 56, and is formed to have an arc shape in a part of the right wall plate 20 on the rear wall plate 23 side and the lower end 15B side and a part of the right wall plate 20 on the front wall plate 22 side and the lower end 15B side. The first guide arc-shaped groove 80 is open toward the right lid plate 53.

As illustrated in FIG. 15, the second guide arc-shaped groove 81 is formed in the left wall plate 21 to be located between the roller wheel 6 and the front wall plate 22 in the front-and-rear direction UD. The second guide arc-shaped groove 81 is formed concentrically with the second-lid pivot shaft 57, and is formed to have an arc shape in a part of the left wall plate 21 on the rear wall plate 23 side and the lower end 15B side and a part of the left wall plate 21 on the front wall plate 22 side and the lower end 15B side. The second guide arc-shaped groove 81 is open toward the left lid plate 54. The second guide arc-shaped groove 81 is formed in the same arc shape as that of the first guide arc-shaped groove 80.

As illustrated in FIG. 14, the first stopping protrusion 82 is located in the first guide arc-shaped groove 80. The first stopping protrusion 82 is located in a part of the first guide arc-shaped groove 80 on the front wall plate 22 side, and is formed to project from a groove bottom surface BOA of the first guide arc-shaped groove 80 toward the right lid plate 53. The first stopping protrusion 82 has a first guide slope 86 on a rear side in the front-and-rear direction UD.

As illustrated in FIG. 15, the second stopping protrusion 83 is located in the second guide arc-shaped groove 81. The second stopping protrusion 83 is located in a part of the second guide arc-shaped groove 81 on the front wall plate 22 side, and is formed to project from a groove bottom surface 81A of the second guide arc-shaped groove 81 toward the left lid plate 54. The second stopping protrusion 83 is formed at the same position as the first stopping protrusion 82. The first stopping protrusion 83 has a second guide slope 87 on a rear side in the front-and-rear direction UD.

As illustrated in FIG. 10, FIG. 11, and FIG. 14, the first guide protrusion 84 is formed on the right wall plate 20 of the lid 8. The first guide protrusion 84 projects from the right wall plate 20. The first guide protrusion 84 is inserted into the first guide arc-shaped groove 80 in such a manner that a gap is defined between the first guide protrusion 84 and the groove bottom surface BOA of the first guide arc-shaped groove 80.

As illustrated in FIG. 10, FIG. 11, and FIG. 14, the second guide protrusion 85 is formed on the left wall plate 21 of the lid 8. The second guide protrusion 85 projects from the left wall plate 21. The second guide protrusion 85 is inserted into the second guide arc-shaped groove 81 in such a manner that a gap is defined between the second guide protrusion 85 and the groove bottom surface 81A of the second guide arc-shaped groove 81. The second guide protrusion 85 is formed at the same position as the first guide protrusion 84.

Under the closed state, as illustrated in FIG. 18(*a*), the first and second guide protrusions 84 and 85 of the open-lid lid holder 11 are located in parts of the first and second guide arc-shaped grooves 80 and 81 on the rear wall plate 23 side. Under the closed state, the first and second guide protrusions 84 and 85 are in abutment against rear groove ends 80B and 81B of the first and second guide arc-shaped grooves 80 and 81, respectively.

As illustrated in FIG. 18(*b*), along with the rotation of the lid 8, which is in the closed state, in a direction of opening the discharge port 24, the first and second guide protrusions 84 and 85 are brought into abutment against the first and second guide slopes 86 and 87, pass over the first and second stopping protrusions 82 and 83, and then are located in parts of the first and second guide arc-shaped grooves 80 and 81 on the front wall plate 22 side, respectively. When the lid 8 is in the open state, a front end of the upper lid plate 55 is in abutment against the bottom wall plate 27 (lower end 15B)

As illustrated in FIG. 18(*c*), under the open state, the first and second guide protrusions 84 and 85 are located between front groove ends of the first and second guide arc-shaped grooves 80 and 81 and the first and second stopping protrusions 82 and 83.

Along with an action on the lid 8, which is in the open state, with a force smaller than a given rotational force (smaller than a given force) in the direction of closing the lid 8, the first and second guide protrusions 84 and 85 are brought into abutment against the first and second stopping protrusions 82 and 83, respectively. As a result, the open-lid lid holder 11 maintains the open state of the lid 8.

With the above-mentioned configuration, when the discharge port 24 is directed downward in the up-and-down direction UD, dirt and dust collected in the first and second dust-collection chambers 1B and IC (internal space 1A) can be discharged without causing the lid 8 to be closed.

Along with an action on the lid 8, which is in the open state, with a rotational force equal to or larger than a given rotational force (force equal to or larger than a given force) in the direction of closing the discharge port 24, the first and second guide protrusions 84 and 85 pass over the first and second stopping protrusions 82 and 83 to be located in parts of the first and second guide arc-shaped grooves 80 and 81, which are located at lower ends of the right and left wall plate 20 and 21 on the rear wall plate 23 side. The first and second guide protrusions 84 and 85 are brought into abutment against the rear groove ends 80B and 81B of the first and second guide arc-shaped grooves 80 and 81, respectively.

In this manner, the lid 8 is brought into a closed state to thereby close the discharge port 24.

Next, cleaning with the manual cleaning tool X is described with reference to FIG. 5 to FIG. 7.

For convenience of description, it is assumed that, as illustrated in FIG. 6, the protruding pieces 38 are located on the first dust-catch brush 39 side and the drum main body 37 is in abutment against the stopper pieces 17 and 18 on the front side in the front-and-rear direction UD.

The manual cleaning tool X is placed with the roller wheels 5 and 6 being in contact with a target to be cleaned (hereinafter referred to as "target to be cleaned") such as a carpet, a tatami mat, or a wooden floor and with the roller brush 7 (cut piles 52), the second dust-catch brush 40

(inclined piles), and the protruding pieces 38 being in abutment against the target to be cleaned.

Subsequently, when the handle 34 is gripped to move the casing 1 forward in the front-and-rear direction FR, the roller brush 7 and the drum main body 37 of the dust-catch brush 2 are rotated in the one direction.

In this manner, as illustrated in FIG. 5, the roller brush 7 collects dirt and dust in the second dust-collection chamber IC (in the internal space IA) with use of the cut piles 52, and the dust-catch brush 2 collects dust in the first dust-collection chamber IB with use of the second dust-catch brush 40. At this time, the dust adhering to the first dust-catch brush 39 is removed with the first dust-removal brush 43 of the first dust-removal brush 3 to be collected in the first dust-collection chamber IB. The drum main body 37 is brought into abutment against the stopper pieces 17 and 18 from a rear side in the front-and-rear direction FRb.

Subsequently, when the casing 1 is moved rearward in the front-and-rear direction FR, the roller brush 7 and the drum main body 37 of the dust-catch brush 2 are rotated in the another direction.

In this manner, as illustrated in FIG. 6, the roller brush 7 collects dirt and dust in the second dust-collection chamber IC (in the internal space IA) with use of the cut piles 52, and the dust-catch brush 2 collects dust in the first dust-collection chamber IB with use of the first dust-catch brush 39. At this time, the dust adhering to the second dust-catch brush 40 is removed with the second dust-removal brush 45 of the second dust-removal brush 4 to be collected in the first dust-collection chamber IB. The drum main body 37 is brought into abutment against the stopper pieces 17 and 18 from a front side in the front-and-rear direction UD.

In this manner, when the casing 1 is reciprocated in the front-and-rear direction UD, the manual cleaning tool X collects dirt and dust in the first and second dust-collection chambers IB and IC (in the internal space IA).

When the roller brush 7 (cut piles 52) and the dust-catch brush 2 are pressed against the target to be cleaned along with forward movement of the casing 1, the lid 8, which is in the closed state, is subjected to a rotational force in the direction of opening the discharge port.

At this time, as illustrated in FIG. 7, under the closed state, the protrusion inclined surfaces 75 of the first claws 68 and 69 are pressed against the protrusion-stop inclined surfaces 71 of the button-stop protrusions 65 and 66 from below in the up-and-down direction UD. Under the closed state, the protrusion flat surface 78 of the second claw 70 is pressed against the protrusion-stop flat surfaces 72 of the handle stopping protrusions 65 and 66 from below in the up-and-down direction UD. In this manner, the rotation of the lid 8, which is in the closed state, in the direction of opening the discharge port 24 is restricted cleaning.

INDUSTRIAL APPLICABILITY

The present invention is optimal for cleaning of a carpet, a tatami mat, a wooden floor, and a vehicle interior of an automobile.

REFERENCE SIGNS LIST

X manual cleaning tool
1 casing
5, 6 roller wheel
7 roller brush
8 lid
15 frame main body
46 rigid shaft
47, 48 guide roller
49 cleaning brush cloth
51 foundation cloth
52 cut pile fiber

The invention claimed is:

1. A manual cleaning tool, comprising:

a casing including a frame main body having a right wall plate and a left wall plate arranged in a left-and-right direction and a front wall plate and a rear wall plate arranged in a front-and-rear direction, which define an internal space, the casing having a discharge port defined by upper ends of the wall plates in an up-and-down direction;

a pair of roller wheels pivotably mounted to the frame main body;

a roller brush provided inside the casing;

a lid pivotably mounted to the frame main body and configured to open and close the discharge port, and an open-lid holder configured to hold the lid in an open state of the discharge port, wherein the roller brush includes:

a brush shaft; and a cleaning brush cloth including a foundation cloth and cut piles raised from a cloth front surface of the foundation cloth wound helically around a shaft outer-peripheral surface of the brush shaft, wherein the roller brush is provided inside the casing with the shaft center line of the brush shaft being matched with the left-and-right direction and part of the cut piles of the cleaning brush cloth projecting beyond the lower ends of the wall plates, wherein the the shaft ends of the brush shaft are pivotably supported by the frame main body, wherein the lid includes:

a right lid plate and a left lid plate arranged in the left-and-right direction; and an upper lid plate arranged between the right lid plate and the left lid plate and formed integrally with the right lid plate and the left lid plate, wherein the right lid plate is located on an outer side of the right wall plate, and is pivotably supported in the right wall plate, wherein the left lid plate is located on an outer side of the left wall plate, and is pivotably supported in the left wall plate, wherein the lid is pivotably mounted to the frame main body, wherein the open-lid lid holder includes:

a stopping protrusion formed to project from the right wall plate toward the right lid plate; and a guide protrusion formed to project from the right lid plate, wherein, when the lid is rotated from a closed state and in a direction of opening the discharge port, the guide protrusion passes over the stopping protrusion and is brought into abutment against the stopping protrusion, and maintains the open state of the lid.

* * * * *